US007058187B2

(12) United States Patent
Ohta

(10) Patent No.: US 7,058,187 B2
(45) Date of Patent: Jun. 6, 2006

(54) AUTOMATIC SOUND FIELD CORRECTING SYSTEM AND A SOUND FIELD CORRECTING METHOD

(75) Inventor: Yoshiki Ohta, Saitama (JP)

(73) Assignee: Pioneer Corporation, Tokyo (JP)

( * ) Notice: Subject to any disclaimer, the term of this patent is extended or adjusted under 35 U.S.C. 154(b) by 534 days.

(21) Appl. No.: 09/781,276

(22) Filed: Feb. 13, 2001

(65) Prior Publication Data

US 2001/0016046 A1 Aug. 23, 2001

(30) Foreign Application Priority Data

Feb. 14, 2000 (JP) ..... P. 2000-035036

(51) Int. Cl.
*H03G 5/00* (2006.01)

(52) U.S. Cl. ..... 381/98; 381/103; 381/101; 381/102; 381/107; 381/108

(58) Field of Classification Search ..... 381/98, 381/103, 94.3, 101, 102, 107, 108, 109
See application file for complete search history.

(56) References Cited

U.S. PATENT DOCUMENTS 5,386,478 A * 1/1995 Plunkett ..... 381/103
5,581,621 A * 12/1996 Koyama et al. ..... 381/103

FOREIGN PATENT DOCUMENTS

EP 624 947 A2 11/1994

OTHER PUBLICATIONS

Patent Abstracts of Japan, vol. 005, No. 129, Aug. 19, 1981.

* cited by examiner

*Primary Examiner*—Huyen Le
*Assistant Examiner*—Justin Michalski
(74) *Attorney, Agent, or Firm*—Sughrue Mion, PLLC

(57) ABSTRACT

A filter coefficient of a graphic equalizer GEQ is corrected based on detection results of reproduced sounds generated by supplying a noise to all frequency band loudspeakers $\mathbf{6}_{FL}$ to $\mathbf{6}_{RR}$ and a low frequency band exclusively reproducing loudspeaker $\mathbf{6}_{WF}$ via the graphic equalizer GEQ. Then, attenuation factors of channel-to-channel attenuators $ATG_1$ to $ATG_5$ are corrected based on the detection results of the reproduced sounds generated by supplying the noise to the loudspeakers $\mathbf{6}_{FL}$ to $\mathbf{6}_{RR}$ via the graphic equalizer. Then, delay times of delay circuits $DLY_1$ to $DLY_k$ are corrected based on the detection results of the reproduced sounds generated by supplying the noise to the loudspeakers $\mathbf{6}_{FL}$ to $\mathbf{6}_{WF}$ via the graphic equalizer. Then, an attenuation factor of a channel-to-channel attenuator $ATG_k$ is corrected based on the detection results of the reproduced sounds generated by supplying the noise to the loudspeakers $\mathbf{6}_{FL}$ to $\mathbf{6}_{RR}$ via the graphic equalizer and the detection result of the reproduced sound generated by supplying the noise to the loudspeaker $\mathbf{6}_{WF}$ via the graphic equalizer, whereby levels of the reproduced sounds reproduced by the loudspeakers $\mathbf{6}_{FL}$ to $\mathbf{6}_{WF}$ are adjusted to be made flat over the audio frequency band.

24 Claims, 11 Drawing Sheets

AUTOMATIC SOUND FIELD CORRECTING SYSTEM AND A SOUND FIELD CORRECTING METHOD

BACKGROUND OF THE INVENTION

The present invention relates to an automatic sound field correcting system and a sound field correcting method for automatically correcting a sound field characteristic in an audio system having a plurality of loudspeakers.

The audio system that is equipped with a plurality of loudspeakers to provide a high quality sound field space is required to produce automatically the proper sound field space that can give a presence. In other words, when the listener tries to get the proper sound field space by himself or herself by operating the audio system, it is extremely hard to properly adjust a phase characteristic, a frequency characteristic, a sound pressure level, etc. of a reproduced sound that is played back via a plurality of loudspeakers. For this reason, it is required to correct automatically the sound field characteristic on the audio system side.

In the prior art, as the audio system of this type, the audio system disclosed in the Japanese Utility Model Application Publication No. Hei 6-13292 has been known. In this audio system in the prior art, an equalizer that receives audio signals on a plurality of channels to adjust these frequency characteristics of respective audio signals and a plurality of delay circuits that delay the audio signals output from the equalizer every channel are provided, and then outputs of respective delay circuits are supplied to a plurality of loudspeakers.

Also, in order to correct the sound field characteristic, there are provided a pink noise generator, an impulse generator, a selector circuit, a microphone used to measure the reproduced sound being reproduced by the loudspeakers, a frequency analyzing means, and a delay time calculating means. Then, a pink noise generated by the pink noise generator is supplied to the equalizer via the selector circuit, and an impulse signal generated by the impulse generator is directly supplied to the loudspeakers via the selector circuit.

Upon correcting the phase characteristic of the sound field space, propagation delay times of the impulse sound from the loudspeakers to a listening position are measured by measuring the impulse sound reproduced via the loudspeakers by the microphone while supplying directly the impulse signal from the above impulse generator to the loudspeakers and then analyzing the measured signals by using the delay time calculating means.

In other words, the propagation delay times of respective impulse sounds are measured by directly supplying the impulse signal to individual loudspeakers while shifting a time and calculating time differences from points of time when respective impulse signals are supplied to respective loudspeakers to points of time when respective impulse sounds being reproduced by every loudspeaker come up to the microphone by using the delay time calculating means. Thus, the phase characteristic of the sound field space can be corrected by adjusting the delay times of respective channels of the above delay circuit based on respective measured propagation delay times Also, upon correcting the frequency characteristic of the sound field space, the pink noise is supplied from the pink noise generator to the equalizer and then the reproduced sounds of the pink noise being reproduced via a plurality of loudspeakers are measured by the microphone, and then frequency characteristics of these measured signals are analyzed by the frequency analyzing means. Thus, the frequency characteristic of the sound field space can be corrected by feedback-controlling the frequency characteristic of the equalizer based on the analyzed results.

SUMMARY OF THE INVENTION

In the audio system in the prior art, as described above, in order to correct the frequency characteristic of the sound field space, such a method is employed that the frequency characteristics of the reproduced sounds of the pink noise are analyzed by using a group of narrow-band filters and then the analyzed results are fed back to the equalizer.

Now, upon producing the reproduced sounds of the pink noise, the pink noise is supplied to the equalizer after the frequency characteristic of the equalizer is set to a frequency characteristic which mates with the audio playback. Accordingly, the reproduced sounds of the pink noise being reproduced via a plurality of loudspeakers reach the microphone and then the frequency characteristics of the reproduced sound of the pink noise are analyzed by a group of narrow-band filters.

However, in case the frequency characteristics of measured signals derived from the reproduced sounds of the pink noise being reproduced via a plurality of (all) loudspeakers are frequency-analyzed by individual narrow- band filters in a group of narrow-band filters, the analyzed result suitable for the frequency characteristic of the equalizer cannot be obtained with good precision. As a result, there is such a subject that, if the frequency characteristic of the equalizer is feedback-controlled based on the analyzed result, it becomes difficult to correct properly the frequency characteristic of the sound field space.

In addition, there is such another subject that, since the phase characteristic of the sound field space is corrected based on the delay times that are obtained by supplying directly the impulse signal to the loudspeakers, the phase characteristic of the overall audio system cannot be corrected into the phase characteristic that can produce the proper sound field space.

It is an object of the present invention to overcome the above subjects in the prior art, and provide an automatic sound field correcting system and a sound field correcting method capable of providing a higher quality sound field space.

An automatic sound field correcting system of the present invention is an automatic sound field correcting system in an audio system for supplying a plurality of input audio signals to a plurality of sound generating means via a plurality of signal transmission lines, each of the plurality of signal transmission lines including an equalizer for adjusting a frequency characteristic of the audio signal, a channel-to-channel level adjusting means for adjusting a level of the audio signal, and a delaying means for adjusting a delay time of the audio signal, whereby the input audio signals are supplied to the sound generating means via the equalizers, the channel-to-channel level adjusting means, and the delaying means, the correcting system comprising a noise generating means for supplying a noise to respective signal transmission lines independently in correcting a sound field; detecting means for detecting reproduced sounds of the noise reproduced by the sound generating means; frequency characteristic correcting means for correcting frequency characteristics of the equalizers based on detection results of the detecting means; channel-to-channel level correcting means for correcting an adjusted amount of the plurality of channel-to-channel level adjusting means based on the detection results of the detecting means; and phase characteristic correcting means for calculating phase characteristics of the reproduced sounds reproduced by the sound generating means based on the detection results of the detecting means and also correcting delay times of the delaying means based on calculated phase characteristics.

In the automatic sound field correcting system having such configuration, the equalizers, the channel-to-channel level adjusting means, and the delaying means are provided in the signal transmission lines via which the audio sound is reproduced.

In such configuration, in correcting the sound field, the noise is supplied from the noise generating means to the equalizers every signal transmission line, and then respective reproduced sounds generated correspondingly are detected by the detecting means. The frequency characteristic correcting means corrects the frequency characteristics of the equalizers based on detection results of the detecting means. Also, since the channel- to-channel level correcting means corrects the adjusted amount of the channel-to-channel level adjusting means based on the detection results of the detecting means, the levels of the audio signals supplied to respective sound generating means between the so-called channels are corrected precisely. In addition, since the phase characteristic correcting means corrects the delay times of the delaying means based on the detection results of the detecting means, the phase characteristics of the audio signals supplied to respective sound generating means are corrected.

Accordingly, the frequency characteristic and the phase characteristic of the audio signals that are supplied to respective sound generating means can be automatically and precisely corrected in reproducing the audio sound. Also, the rationalization of the phase characteristic and the frequency characteristic of the reproduced sounds reproduced by respective sound generating means at the listening position can be achieved. Therefore, the high quality sound field space with the presence can be provided.

In particular, in correcting the sound field, the noise is supplied to the sound generating means via the equalizers, the channel-to-channel level adjusting means, and the delaying means, via which the audio sounds are reproduced, and then the equalizers, the channel-to-channel level adjusting means, and the delaying means are corrected based on measured results of the reproduced sounds of the noise reproduced by the sound generating means. Therefore, the correction of the sound field can be performed under the same condition as the reproduction of the audio sound. For this reason, the sound field correction can be executed while totally taking account of the characteristic of the overall audio system and the characteristic of the sound field space.

Also, an automatic sound field correcting system of the present invention is an automatic sound field correcting system in an audio system for supplying a plurality of input audio signals to all frequency band sound generating means and a low frequency band exclusively reproducing sound generating means via a plurality of signal transmission lines, each of the plurality of signal transmission lines including an equalizer for adjusting a frequency characteristic of the audio signal, a channel-to-channel level adjusting means for adjusting a level of the audio signal, and a delaying means for adjusting a delay time of the audio signal, whereby the input audio signals are supplied to the sound generating means via the equalizers, the channel-to-channel level adjusting means, and the delaying means, the correcting system comprising a noise generating means for supplying a noise to the respective signal transmission lines independently in correcting a sound field; detecting means for detecting reproduced sounds of the noise reproduced by the sound generating means; frequency characteristic correcting means for correcting frequency characteristics of the equalizers based on detection results of the detecting means; first channel-to-channel level correcting means for correcting an adjusted amount of the plurality of channel-to-channel level adjusting means of the signal transmission lines, in which the all frequency band sound generating means are provided, out of the plurality of channel-to-channel level adjusting means based on the detection results of the detecting means; phase characteristic correcting means for calculating phase characteristics of the reproduced sounds reproduced by respective sound generating means based on the detection results of the detecting means and also correcting delay times of the delaying means based on calculated phase characteristics; and second channel-to-channel level correcting means for correcting an adjusted amount of the plurality of channel-to-channel level adjusting means of the signal transmission lines, in which the low frequency band exclusively reproducing sound generating means are provided, based on the detection results of the detecting means.

Also, the second channel-to-channel level correcting means corrects an adjusted amount of the channel-to-channel level adjusting means such that a sum of a spectrum average level of the reproduced sound reproduced by all frequency band sound generating means in the low frequency band and a spectrum average level of the reproduced sound reproduced by a low frequency band exclusively reproducing sound generating means in the low frequency band and a spectrum average level of the reproduced sound reproduced by the all frequency band sound generating means in the middle/high frequency band are made equal to a ratio of target curve data.

According to the automatic sound field correcting system having such configuration, since the correction of the sound field can be carried out under the same condition as the reproduction of the audio sound, the correction of the sound field can be implemented while totally taking account of the characteristic of the overall audio system and the characteristic of the sound field environment, and in addition the first channel-to-channel level correcting means corrects the adjusted amount of the channel-to-channel level adjusting means for the all frequency band sound generating means and also the second channel-to-channel level correcting means corrects the adjusted amount of the channel-to-channel level adjusting means for the low frequency band exclusively reproducing sound generating means, whereby the levels of the reproduced sounds reproduced by the all frequency band sound generating means and the low frequency band exclusively reproducing sound generating means can be made flat over the full audio frequency band.

Accordingly, generation of the sound field space to generate a feeling of physical disorder such that the levels of the reproduced sounds reproduced by the low frequency band exclusively reproducing sound generating means in the low frequency band and the reproduced sounds reproduced by the all frequency band sound generating means in the all frequency band are enhanced or weakened at a certain frequency can be prevented, and also the high quality sound field space with the presence can be implemented.

Also, a sound field correcting method of the present invention is a sound field correcting method in an audio system including a plurality of signal transmission lines for supplying a plurality of input audio signals separately to all frequency band sound generating means and a low frequency band exclusively reproducing sound generating means, each of the plurality of signal transmission lines including an equalizer for adjusting a frequency characteristic of the audio signal, a channel-to-channel level adjusting means for adjusting a level of the audio signal, and a delaying means for adjusting a delay time of the audio signal, whereby the input audio signals are supplied to the sound generating means via the equalizers, the channel-to-channel level adjusting means, and the delaying means, the method comprising a first step of measuring reproduced sounds reproduced by the all frequency band sound generating means and a low frequency band exclusively reproducing sound generating means by inputting a noise, and then correcting frequency characteristics of the equalizers based on measured results; a second step of measuring the reproduced sounds reproduced by the all frequency band sound generating means and a low frequency band exclusively reproducing sound generating means by inputting the noise, and then correcting an adjusted amount of the channel-to-channel level adjusting means for the all frequency band sound generating means based on the measured results; a third step of measuring the reproduced sounds reproduced by the all frequency band sound generating means and a low frequency band exclusively reproducing sound generating means by inputting the noise, and then correcting delay times of the delaying means based on the measured results; a fourth step of measuring independently reproduced sounds reproduced by the all frequency band sound generating means and reproduced sounds reproduced by the low frequency band exclusively reproducing sound generating means; and a fifth step of correcting an adjusted amount of the channel-to-channel level adjusting means based on measured results measured by the fourth step such that a sum of a spectrum average level of the reproduced sounds reproduced by the all frequency band sound generating means in a low frequency band and a spectrum average level of the reproduced sound reproduced by a low frequency band exclusively reproducing sound generating means in the low frequency band and a spectrum average level of the reproduced sound reproduced by the all frequency band sound generating means in a middle/high frequency band are set equal to a ratio of target curve data. Accordingly, generation of the sound field space to generate a feeling of physical disorder such that the levels of the reproduced sounds reproduced by the low frequency band exclusively reproducing sound generating means in the low frequency band and the reproduced sounds reproduced by the all frequency band sound generating means in the all frequency band are enhanced or weakened at a certain frequency can be prevented, and also the high quality sound field space with the presence can be accomplished.

According to the sound field correcting method of the present invention, since the correction of the sound field can be carried out under the same condition as the reproduction of the audio sound, the correction of the sound field can be implemented while totally taking account of the characteristic of the overall audio system and the characteristic of the sound field environment, and in addition the levels of the reproduced sounds reproduced by the all frequency band sound generating means and the low frequency band exclusively reproducing sound generating means can be made flat over the full audio frequency band. Accordingly, generation of the sound field space to generate the feeling of physical disorder such that the levels of the reproduced sounds reproduced by the low frequency band exclusively reproducing sound generating means in the low frequency band and the reproduced sounds reproduced by the all frequency band sound generating means in the all frequency band are enhanced or weakened at a certain frequency can be prevented, and thus the high quality sound field space with the presence can be implemented.

DETAILED DESCRIPTION OF THE PREFERRED EMBODIMENTS

Figure 1:
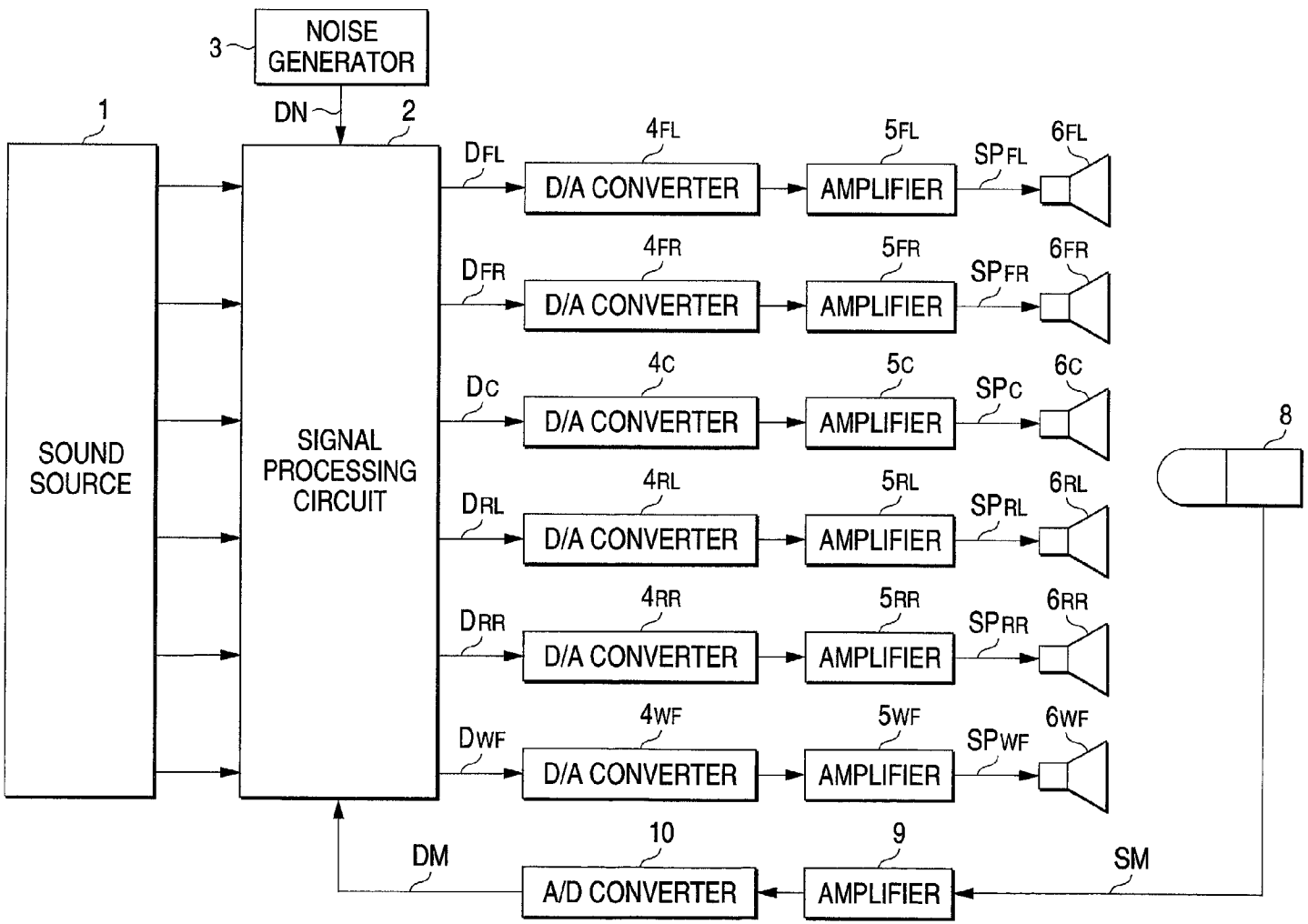
FIG. 1 is a block diagram showing a configuration of an audio system including an automatic sound field correcting system according to the present embodiment.
Figure 2:
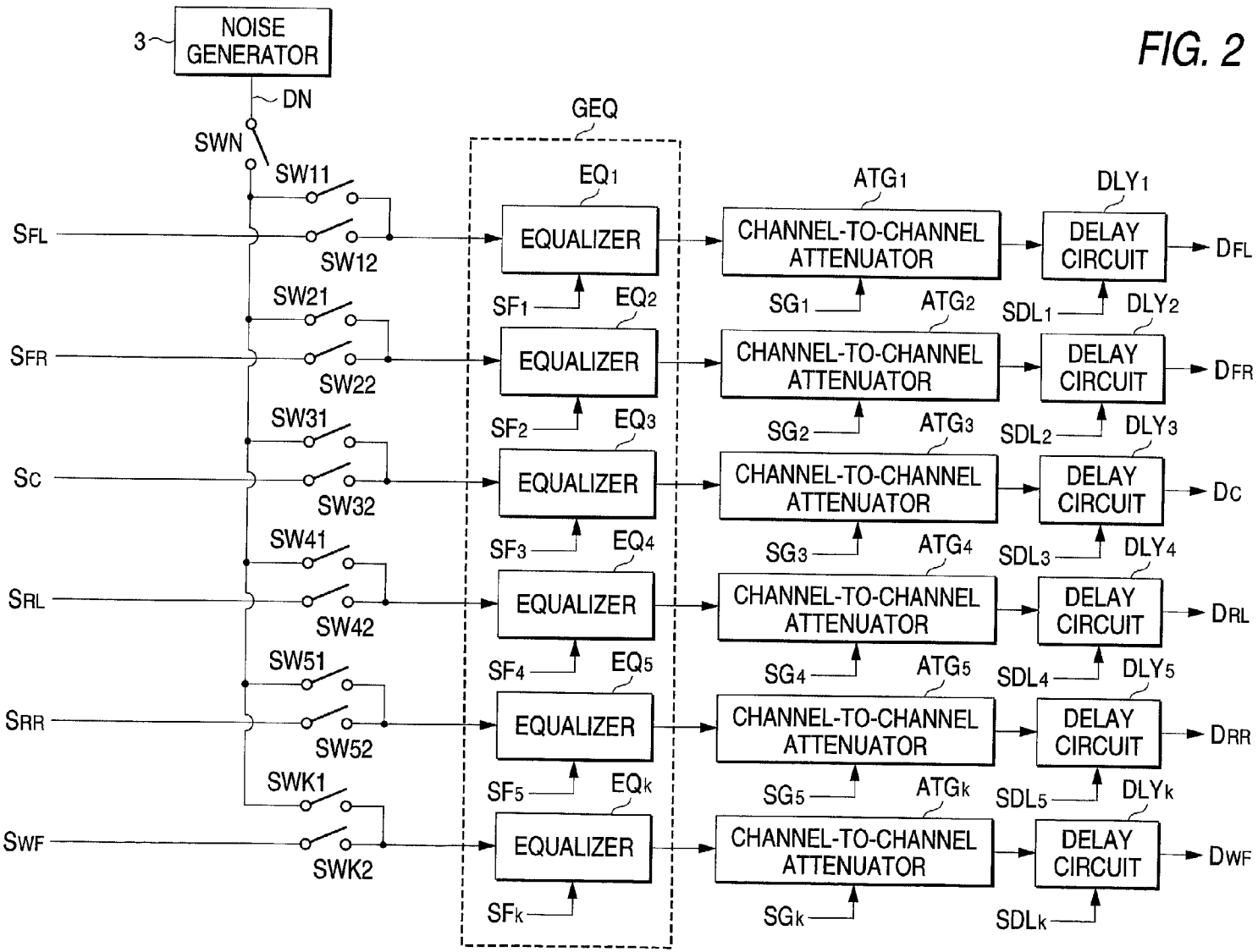
FIG. 2 is a block diagram showing a configuration of the automatic sound field correcting system according to the present embodiment.
Figure 3:
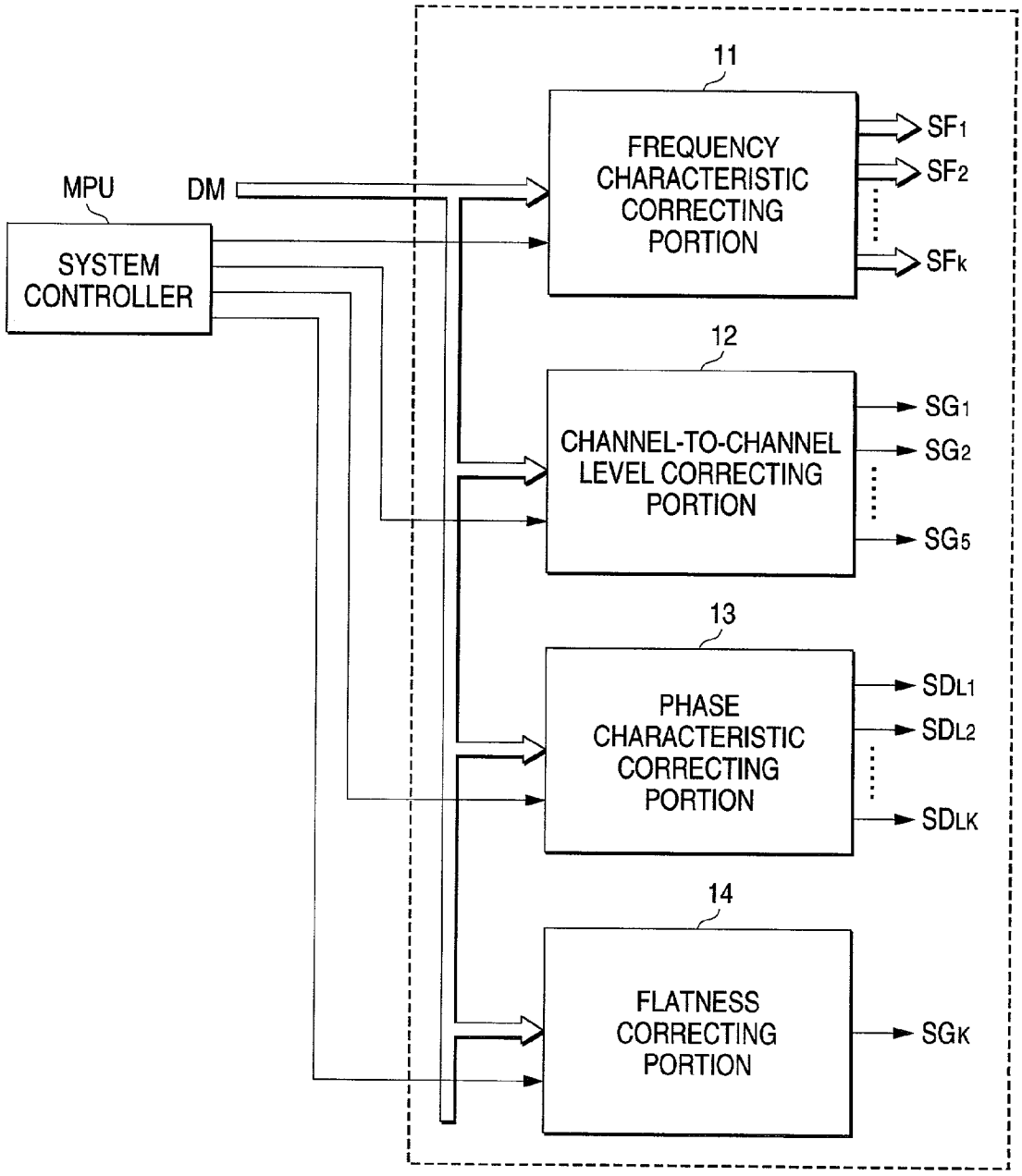
FIG. 3 is a block diagram showing a pertinent configuration of the automatic sound field correcting system according to the present embodiment.
Figure 4:
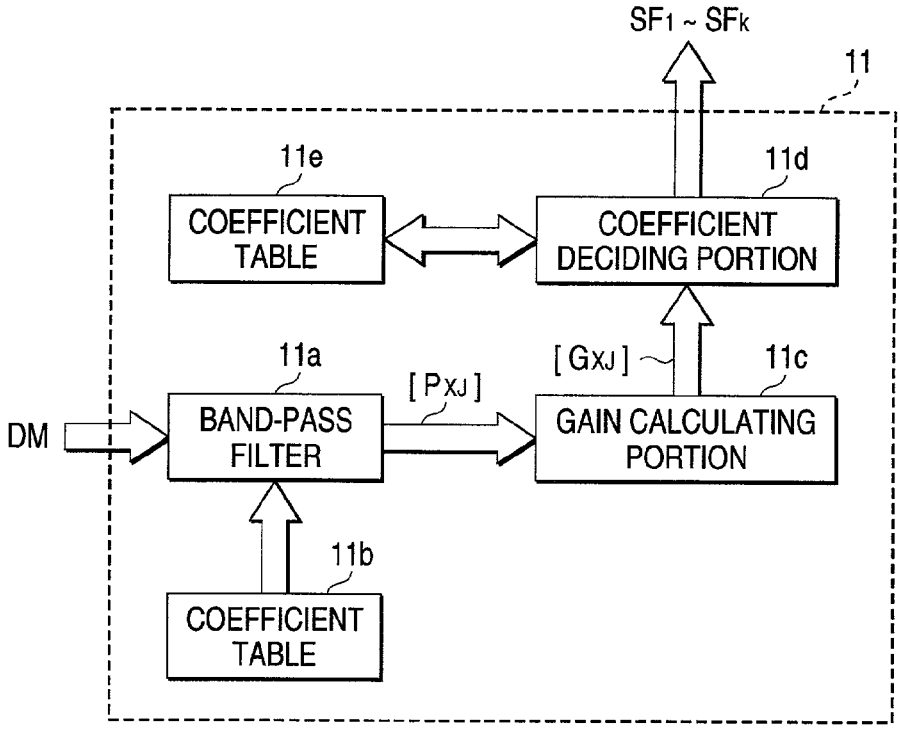
FIG. 4 is a block diagram showing another pertinent configuration of the automatic sound field correcting system according to the present embodiment.

An embodiment of an automatic sound field correcting system of the present invention will be explained with reference to the accompanying drawings hereinafter. FIG. 1 is a block diagram showing a configuration of an audio system including the automatic sound field correcting system according to the present embodiment. FIG. 2 to FIG. 4 are block diagrams showing the configuration of the automatic sound field correcting system.

In FIG. 1, a signal processing circuit 2 to which digital audio signals $S_{FL}$, $S_{FR}$, $S_C$, $S_{RL}$, $S_{RR}$, $S_{WF}$ are supplied from a sound source 1 such as a CD (Compact Disk) player, a DVD (Digital Video Disk or Digital Versatile Disk) player, etc. via a signal transmission line having a plurality of channels, and a noise generator 3 are provided to the present audio system.

Also, D/A converters $\mathbf{4}_{FL}$, $\mathbf{4}_{FR}$, $\mathbf{4}_C$, $\mathbf{4}_{RL}$, $\mathbf{4}_{RR}$, $\mathbf{4}_{WF}$ for converting digital outputs $D_{FL}$, $D_{FR}$, $D_C$, $D_{RL}$, $D_{WF}$ which are signal-processed by the signal processing circuit 2 into analog signals, and amplifiers $\mathbf{5}_{FL}$, $\mathbf{5}_{FR}$, $\mathbf{5}_C$, $\mathbf{5}_{RL}$, $\mathbf{5}_{RR}$, $\mathbf{5}_{WF}$ for amplifying respective analog audio signals being output from these D/A converters are provided. Respective analog audio signals $SP_{FL}$, $SP_{FR}$, $SP_C$, $SP_{RL}$, $SP_{RR}$, $SP_{WF}$ amplified by these amplifiers are supplied to loudspeakers $\mathbf{5}_{FL}$, $\mathbf{5}_{FR}$, $\mathbf{5}_C$, $\mathbf{5}_{RL}$, $\mathbf{5}_{RR}$, $\mathbf{5}_{WF}$ on a plurality of channels arranged in a listening room 7, etc., as shown in FIG. 7, to sound them.

In addition, a microphone 8 for collecting reproduced sounds at a listening position RV, an amplifier 9 for amplifying a sound collecting signal SM output from the microphone 8, and an A/D converter 10 for converting an output of the amplifier 9 into digital sound collecting data DM to supply to the signal processing circuit 2 are provided.

Then, the present audio system provides a sound field space with a presence to the listener at the listening position RV by sounding all frequency band type loudspeakers $\mathbf{6}_{FL}$, $\mathbf{6}_{FR}$, $\mathbf{6}_{C}$, $\mathbf{6}_{RL}$, $\mathbf{6}_{RR}$ each has a frequency characteristic that enables an almost full range of the audio frequency band to reproduce, and a low frequency band exclusively reproducing loudspeaker $\mathbf{6}_{WF}$ that has a frequency characteristic to reproduce only the so-called heavy and low sound.

Figure 7:
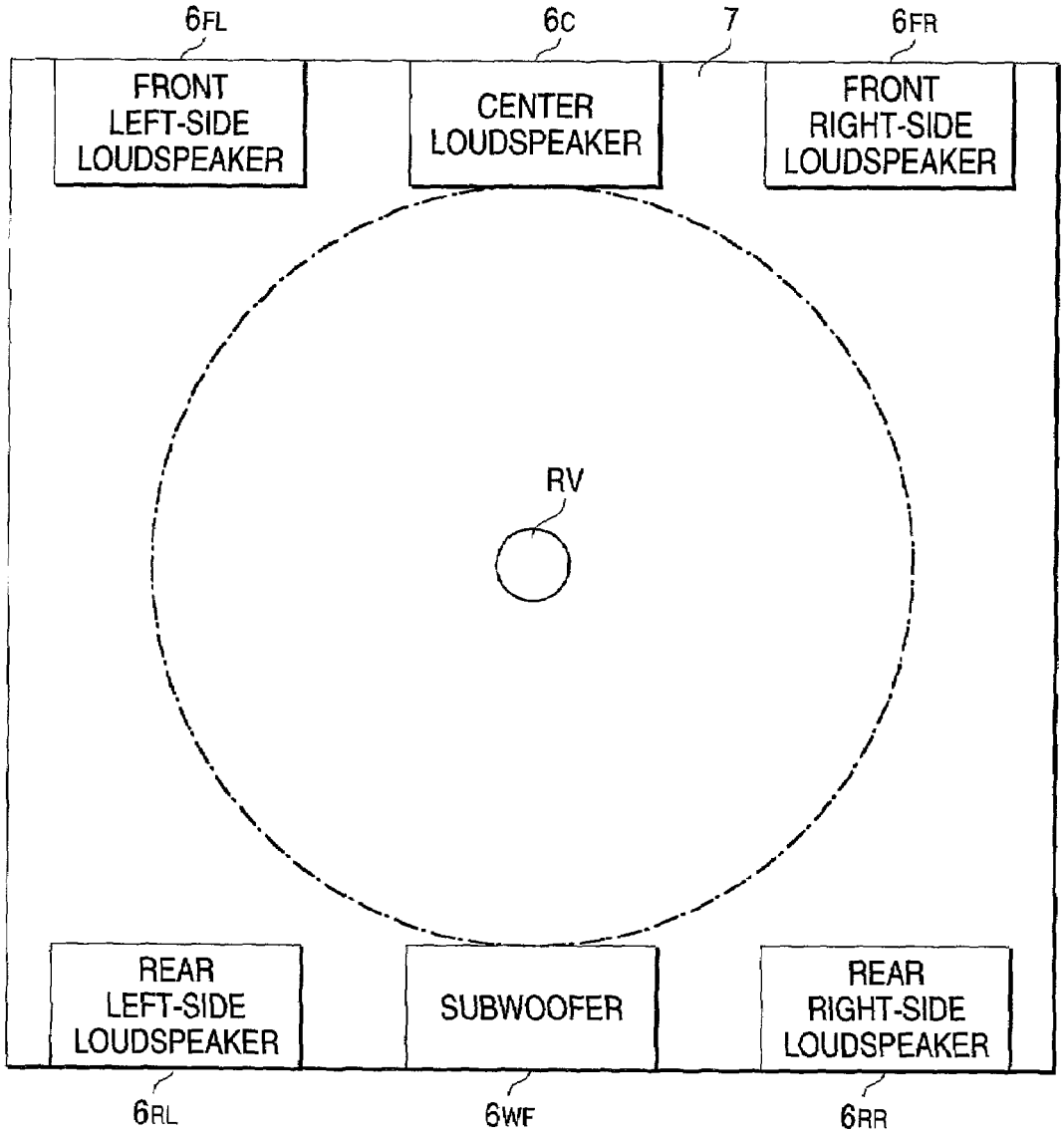
FIG. 7 is a view showing an example of arrangement of loudspeakers.

For example, as shown in FIG. 7, in the case that the listener arranges the front loudspeakers (front left-side loudspeaker, front right-side loudspeaker) $\mathbf{6}_{FL}$, $\mathbf{6}_{FR}$ on two right and left channels and the center loudspeaker $\mathbf{6}_{C}$ in front of the listening position RV, arranged the rear loudspeakers (rear left-side loudspeaker, rear right-side loudspeaker) $\mathbf{6}_{RL}$, $\mathbf{6}_{RR}$ on two right and left channels at the rear of the listening position RV, and arranges the low frequency band exclusively reproducing subwoofer $\mathbf{6}_{WF}$ at any position according to his or her taste, the automatic sound field correcting system installed in the present audio system can implement the sound field space with the presence by sounding six loudspeakers $\mathbf{6}_{FL}$, $\mathbf{6}_{FR}$, $\mathbf{6}_{C}$, $\mathbf{6}_{RL}$, $\mathbf{6}_{RR}$, $\mathbf{6}_{WF}$ by supplying the analog audio signals $SP_{FL}$, $SP_{FR}$, $SP_{C}$, $SP_{RL}$, $SP_{RR}$, $SP_{WF}$, whose frequency characteristic and phase characteristic are corrected, to these loudspeakers.

In this case, in the following explanation, respective channels are denoted by numbers x ($1 \leqq x \leqq k$).

The signal processing circuit 2 is composed of a digital signal processor (DSP), or the like, and comprises a graphic equalizer GEQ and channel-to-channel attenuators $ATG_1$ to $ATG_k$ and delay circuits $DLY_1$ to $DLY_k$, that are shown in FIG. 2, and a frequency characteristic correcting portion 11, a channel-to-channel level correcting portion 12, a phase characteristic correcting portion 13 and a flatness correcting portion 14, that are shown in FIG. 3.

The frequency characteristic correcting portion 11 adjusts frequency characteristics of equalizers $EQ_1$ to $Eq_k$ on respective channels of the graphic equalizer. The channel-to-channel level correcting portion 12 and the flatness correcting portion 14 adjust the attenuation factors of the channel-to-channel attenuators $ATG_1$ to $ATG_k$. The phase characteristic correcting portion 13 adjusts delay times of the delay circuits $DLY_1$ to $DLY_k$, whereby the sound field correction is performed.

Figure 5:
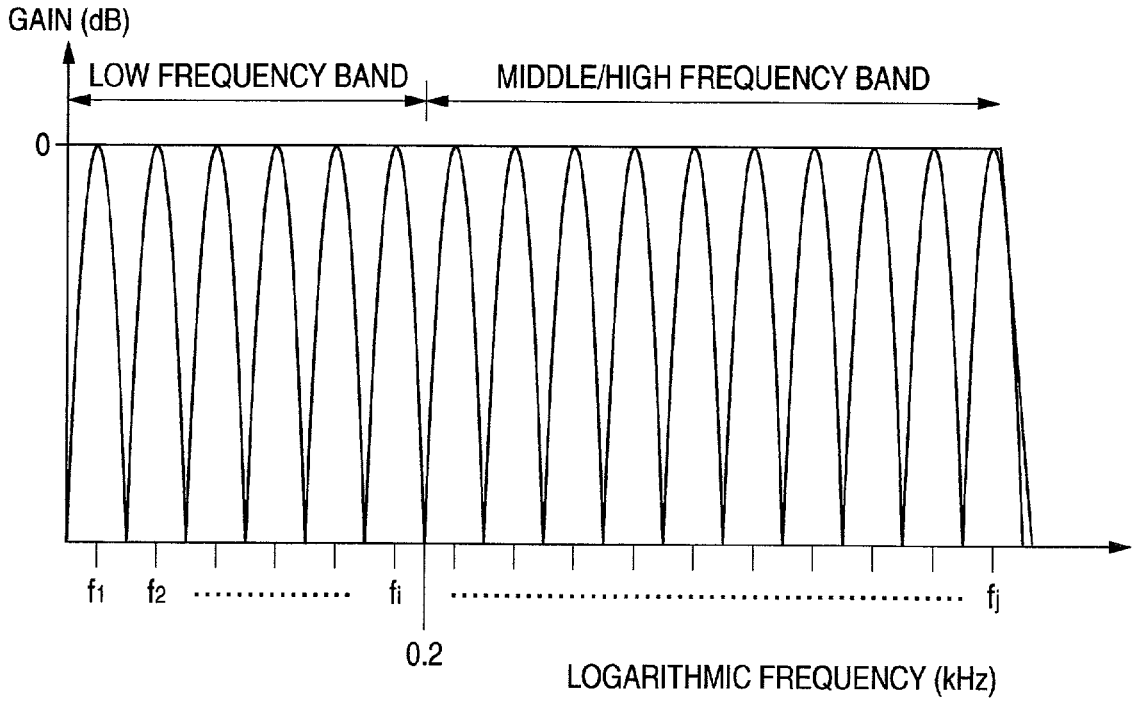
FIG. 5 is a view showing a frequency characteristic of a graphic equalizer.

As shown in a frequency characteristic diagram of FIG. 5, the equalizers $EQ_1$ to $EQ_5$ on first to fifth channels (x=1 to 5) are constructed such that their frequency characteristics can be precisely adjusted for respective j frequencies f1 to fj. More particularly, respective frequencies f1 to fi in FIG. 5 are decided by dividing the low frequency band below about 0.2 kHz into about five ranges, and then respective frequencies fi+1 to fj are decided by dividing the middle/high frequency band in excess of about 0.2 kHz into about thirteen ranges. Then, the frequency characteristics can be precisely adjusted by adjusting filter coefficients of the equalizers $EQ_1$ to $Eq_5$ based on filter coefficient adjust signals $SF_1$ to $SF_5$.

The equalizer $EQ_k$ on the k-th channel is constructed to adjust the frequency characteristic in the low frequency band. Then, the frequency characteristic below about 0.2 kHz shown in FIG. 5 can be precisely adjusted for respective frequencies f1 to fi by adjusting the filter coefficient of the equalizer $EQ_k$ based on filter coefficient adjust signal $SF_k$.

Also, a switch element $SW_{12}$ that ON/OFF-controls an input of the digital audio signal $S_{FL}$ from the sound source 1 and a switch element $SW_{11}$ that ON/OFF-controls an input of a noise signal DN from the noise generator 3 are connected the equalizer $EQ_1$ on the first channel. Also, the switch element $SW_{11}$ is connected to the noise generator 3 via a switch element $SW_N$.

The switch elements $SW_{11}$, $SW_{12}$, $SW_N$ are controlled by a system controller MPU that consists of a microprocessor shown in FIG. 3. At the time of reproducing the audio sound, the switch element $SW_{12}$ is turned ON (conductive) and the switch elements $SW_{11}$, $SW_N$ are turned OFF (nonconductive). At the time of correcting the sound field, the switch element $SW_{12}$ is turned OFF and the switch elements $SW_{11}$, $SW_N$ are turned ON.

In addition, the channel-to-channel attenuator $ATG_1$ is connected to an output contact of the equalizer $EQ_1$, and also the delay circuit $DLY_1$ is connected to an output contact of the channel-to-channel attenuator $ATG_1$. Then, an output $D_{FL}$ of the delay circuit $DLY_1$ is supplied to the D/A converter $\mathbf{4}_{FL}$ in FIG. 1.

The second to k-th channels have similar configuration to the first channel, and include switch elements $SW_{21}$ to $SW_{k1}$ corresponding to the switch element $SW_{11}$ and switch elements $SW_{22}$ to $SW_{k2}$ corresponding to the switch element $SW_{12}$ respectively. Then, the equalizers $EQ_1$ to $EQ_k$, the channel-to-channel attenuators $ATG_2$ to $ATG_k$, and the delay circuits $DLY_1$ to $DLY_k$ are provided following to these switch elements $SW_{22}$ to $SW_{k2}$. Then, output $D_{FR}$ to $D_{WF}$ of the delay circuits $DLY_2$ to $DLY_k$ are supplied to the D/A converters $\mathbf{4}_{FR}$ to $\mathbf{4}_{WF}$ in FIG. 1.

Further, the channel-to-channel attenuators $ATG_1$ to $ATG_5$ on the first to fifth channels change their attenuation factors in the range of 0 dB to the (−) side in compliance with the adjust signals $SG_1$ to $SG_5$ from the channel-to-channel level correcting portion 12 respectively. Also, the channel-to-channel attenuator $ATG_k$ on the k-th channel changes its attenuation factor in the range of 0 dB to the (−) side in compliance with the adjust signal $SG_k$ from the flatness correcting portion 14.

The delay circuit $DLY_1$ to $DLY_k$ on the first to k-th channels change their delay times in compliance with the adjust signal $SDL_1$ to $SDL_k$ from the phase characteristic correcting portion 13.

As shown in FIG. 4, the frequency characteristic correcting portion 11 is constructed to have a band-pass filter 11*a*, a coefficient table 11*b*, a gain calculating portion 11*c*, a coefficient deciding portion 11*d*, and a coefficient table 11*e*.

The band-pass filter 11*a* is composed of narrow-band digital filters that have the frequencies f1 to fj set by the equalizers $EQ_1$ to $EQ_k$ as their center frequencies respectively, and supplies data [PxJ] indicating levels of respective frequencies f1 to fj to the gain calculating portion 11*c* by frequency-discriminating the sound collecting data DM from the D/A converter 10 for respective frequencies f1 to fj. In this case, the frequency discriminating characteristic of the band-pass filter 11*a* is set by the filter coefficient data stored previously in the coefficient table 11*b*.

The gain calculating portion 11*c* calculates gains of the equalizers $EQ_1$ to $EQ_k$ for respective frequencies f1 to fk in correcting the sound field based on the data [PxJ] indicating the above levels, and then supplies calculated gain data [GxJ] to the coefficient deciding portion 11*d*. In other words, the gains of the equalizers $EQ_1$ to $EQ_k$ are counted back for respective frequencies f1 to fk by using the data [PxJ] as the already-known transfer functions of the equalizers $EQ_1$ to $EQ_k$.

The coefficient deciding portion lid generates the filter coefficient adjust signals $SF_1$ to $SF_5$ to adjust the frequency characteristics of the equalizers $EQ_1$ to $EQ_k$ under control of the system controller MPU. Upon correcting the sound field, the coefficient deciding portion 11*d* generates the filter coefficient adjust signals $SF_1$ to $SF_5$ according to the conditions instructed by the listener.

If the standard sound field correction being set previously in the present sound field correcting system is performed without the instruction for the conditions of the correction of the sound field by the listener, the filter coefficient data to adjust the frequency characteristics of the equalizers $EQ_1$ to $EQ_k$ are read from the coefficient table 11*e* based on the gain data [GxJ] supplied from the gain calculating portion 11*c* for respective frequencies f1 to fk, and then the frequency characteristics of the equalizers $EQ_1$ to $EQ_k$ are adjusted by the filter coefficient adjust signals $SF_1$ to $SF_5$ of the filter coefficient data.

In other words, the filter coefficient data to adjust variously the frequency characteristics of the equalizers $EQ_1$ to $EQ_k$ are stored previously as look-up tables in the coefficient table 11*e*. Then, the coefficient deciding portion 11*d* reads the filter coefficient data corresponding to the gain data [GxJ] and then supplies such read filter coefficient data as the filter coefficient adjust signals $SF_1$ to $SF_5$ to the equalizers $EQ_1$ to $EQ_k$, to thereby adjust the frequency characteristic every channel.

If the listener selects the target curve, described later, to perform the correction of the sound field, the coefficient deciding portion 11*d* memory-accesses the target curve data TGx stored previously in the coefficient table 11*e* and also memory-accesses the filter coefficient data corresponding to the gain data [GxJ] supplied from the gain calculating portion 11*c*. Then, the coefficient deciding portion 11*d* generates the filter coefficient data, that are modulated by the target curve data TGx, by executing predetermined calculations based on the target curve data TGx and the filter coefficient data, and then supplies the filter coefficient data as the filter coefficient adjust signals $SF_1$ to $SF_5$ to the equalizers $EQ_1$ to $EQ_k$, to thereby adjust the frequency characteristic every channel.

In this case, the target curve denotes the frequency characteristic of the reproduced sound that can suit the listener's taste. In the present audio system, in addition to the target curve used to generate the reproduced sound having the frequency characteristic that is suitable for the classic music, various target curve data used to generate the reproduced sounds having the frequency characteristics that are suitable for rock music, pops, vocal, etc. are stored.

The channel-to-channel level correcting portion 12 receives respective sound collecting data DM obtained when all frequency band loudspeakers $\mathbf{6}_{FL}$, $\mathbf{6}_{FR}$, $\mathbf{6}_{C}$, $\mathbf{6}_{RL}$, $\mathbf{6}_{RR}$ are sounded individually by the noise signal (pink noise) DN output from the noise generator 3, and then measures the levels of the reproduced sounds of respective loudspeakers at the listening position RV based on the sound collecting data DM. Then, the channel-to-channel level correcting portion 12 generates the adjust signals $SG_1$ to $SG_5$ based on these measured results and corrects automatically the attenuation factors of the channel-to-channel attenuators $ATG_1$ to $ATG_5$ by the adjust signals $SG_1$ to $SG_5$. The level adjustment (gain adjustment) between the first to fifth channels is carried out based on the adjustment of the attenuation factors by the channel-to-channel level correcting portion 12.

However, the channel-to-channel level correcting portion 12 does not adjust the attenuation factor of the channel-to-channel attenuator $ATG_k$, but the flatness correcting portion 14 adjusts the attenuation factor of the channel-to-channel attenuator $ATG_k$.

The phase characteristic correcting portion 13 measures the phase characteristics of respective channels based on respective sound collecting data DM obtained when respective loudspeakers $\mathbf{6}_{FL}$, $\mathbf{6}_{FR}$, $\mathbf{6}_{C}$, $\mathbf{6}_{RL}$, $\mathbf{6}_{RR}$ , $\mathbf{6}_{WF}$ are sounded individually by the noise signal (pink noise) DN output from the noise generator 3, and then corrects the phase characteristic of the sound field space in compliance with the measured result.

More particularly, the loudspeakers $\mathbf{6}_{FL}$, $\mathbf{6}_{FR}$, $\mathbf{6}_{C}$, $\mathbf{6}_{RL}$, $\mathbf{6}_{RR}$, $\mathbf{6}_{WF}$ on respective channels are sounded by the noise signal DN every period T, and then cross correlations between resultant sound collecting data $DM_1$, $DM_2$, $DM_3$, $DM_4$, $DM_5$, $DM_k$ on respective channels are calculated. Here, the cross correlation between the sound collecting data $DM_2$ and $DM_1$, the cross correlation between the sound collecting data $DM_3$ and $DM_1$, . . . , the cross correlation between the sound collecting data $DM_k$ and $DM_1$ are calculated, and then peak intervals (phase differences) between respective correlation values are set as their delay times τ2 to τk in respective system circuits $CQT_2$ to $CQT_k$. That is, the delay times τ2 to τk of remaining system circuits $CQT_2$ to $CQT_k$ are calculated on the basis of the phase of the sound collecting data DM1 obtained from the system circuit $CQT_1$ (i.e., phase difference 0, τ1=0). Then, the adjust signals $SDL_1$ to $SDL_k$ are generated based on measured results of these delay times τ2 to τk, and then the phase characteristic of the sound field space is corrected by automatically adjusting respective delay times of the delay circuits $DLY_1$ to $DLY_k$ by using these adjust signals $SDL_1$ to $SDL_k$. In this case, the pink noise is employed to correct the phase characteristic in the present embodiment, but the present invention is not limited to this noise and other noises may be employed.

The flatness correcting portion 14 adjusts the attenuation factor of the channel-to-channel attenuator $ATG_k$, that is not adjusted by the channel-to-channel level correcting portion 12, after the adjustments made by the frequency characteristic correcting portion 11, the channel-to-channel level correcting portion 12, and the phase characteristic correcting portion 13 have been completed.

Although their details are described later, the spectra of the reproduced sounds of the noise reproduced by the all frequency band loudspeakers $\mathbf{6}_{FL}$, $\mathbf{6}_{FR}$, $\mathbf{6}_{C}$, $\mathbf{6}_{RL}$, $\mathbf{6}_{RR}$ are detected by spectrum-analyzing the sound collecting data DM obtained when the all frequency band loudspeakers $\mathbf{6}_{FL}$, $\mathbf{6}_{FR}$, $\mathbf{6}_{C}$, $\mathbf{6}_{RL}$, $\mathbf{6}_{RR}$ except the loudspeaker $\mathbf{6}_{WF}$ are sounded simultaneously based on the noise signal (uncorrelated noise) DN output from the noise generator 3, and in addition the spectrum of the reproduced sounds of the noise reproduced by the loudspeaker $\mathbf{6}_{WF}$ is detected by spectrum-analyzing the sound collecting data DM obtained when only the low frequency band exclusively reproducing loudspeaker $\mathbf{6}_{WF}$ is sounded based on the noise signal (pink noise) DN output from the noise generator 3.

By executing predetermined calculations based on these spectra, there is generated the adjust signal $SG_k$ that makes the frequency characteristic of the reproduced sound flat over all audio frequency bands when all loudspeakers $\mathbf{6}_{FL}$, $\mathbf{6}_{FR}$, $\mathbf{6}_{C}$, $\mathbf{6}_{RL}$, $\mathbf{6}_{RR}$, $\mathbf{6}_{WF}$ are sounded simultaneously.

Figure 6:
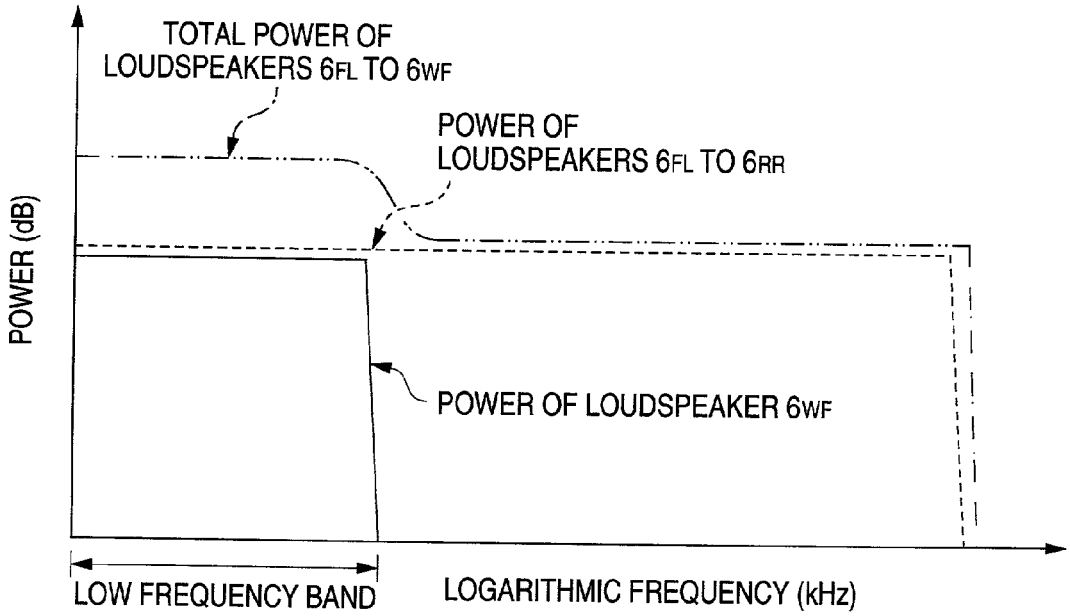
FIG. 6 is a view showing the problem in a low frequency band of a reproduced sound.

That is, as shown in the frequency characteristic diagram of FIG. 6, since the all frequency band loudspeakers $\mathbf{6}_{FL}$, $\mathbf{6}_{FR}$, $\mathbf{6}_{C}$, $\mathbf{6}_{RL}$, $\mathbf{6}_{RR}$ have not only the middle/high frequency band reproducing capability but also the low frequency band reproducing capability, in some cases the levels of the low frequency sounds reproduced by the loudspeakers $\mathbf{6}_{FL}$, $\mathbf{6}_{FR}$, $\mathbf{6}_{C}$, $\mathbf{6}_{RL}$, $\mathbf{6}_{RR}$ and the low frequency sound reproduced by the loudspeaker $\mathbf{6}_{WF}$, for example, become higher than the level of the reproduced sound in the middle/high frequency band if these loudspeakers $6_{FL}$, $6_{FR}$, $6_C$, $6_{RL}$, $6_{RR}$ and the low frequency band exclusively reproducing loudspeaker $6_{WF}$ are sounded. Thus, there is caused such a problem that such low frequency sounds are offensive to the ear and also give the listener an unpleasant feeling. Therefore, the calculating portion 15*d* adjusts the attenuation factor of the channel-to-channel attenuator $ATG_k$ by the adjust signal $SG_k$ such that a sum of the spectrum average levels of the above low frequency band sounds and the spectrum average levels of the middle/high frequency band sounds are set equal to a ratio of the target characteristics (ratio of the target curve data).

In this case, the configuration of the automatic sound field correcting system is explained as above, but more detailed functions will be explained in detail in the explanation of operation.

Next, an operation of the automatic sound field correcting system having such configuration will be explained with reference to flowcharts shown in FIG. 8 to FIG. 12 hereunder.

When the listener arranges a plurality of loudspeakers $6_{FL}$ to $6_{WF}$ in the listening room 7, etc. and connects them to the present audio system, as shown in FIG. 7, for example, and then instructs to start the sound field correction by operating a remote controller (not shown) provided to the present audio system, the system controller MPU operates the automatic sound field correcting system in compliance with this instruction.

First, an outline of the operation of the automatic sound field correcting system will be explained with reference to FIG. 8. In the frequency characteristic correcting process in step S10, the process for adjusting the frequency characteristics of the equalizers $EQ_1$ to $EQ_k$ is carried out by the frequency characteristic correcting portion 11.

In the channel-to-channel level correcting process in step S20, the process for adjusting the attenuation factors of the channel-to-channel attenuators $ATG_1$ to $ATG_5$ is carried out by the channel-to-channel level correcting portion 12. That is, in step S20, the channel- to-channel attenuator $ATG_k$ on the k-th channel is not adjusted.

In the phase characteristic correcting process in step S30, the process for adjusting the delay times of the delay circuits $DLY_1$ to $DLY_k$ for all channels is carried out by the phase characteristic correcting portion 13.

In the flatness correcting process in step S40, the process for making the frequency characteristic of the reproduced sound at the listening position RV flat over the full audio frequency band is carried out by adjusting the attenuation factor of the channel-to-channel attenuator $ATG_k$ on the k-th channel by using the flatness correcting portion 14.

In this manner, the present automatic sound field correcting system executes the sound field correction by performing in sequence the correcting processes that are classified roughly into four stages.

Then, operations in respective process stages will be explained in detail in sequence.

First, the frequency characteristic correcting process in step S10 will be explained in detail. The process in step S10 will be carried out in compliance with the detailed flowchart shown in FIG. 9.

In step S100, the initialization process is executed to make the frequency characteristics of the equalizers $EQ_1$ to $EQ_k$ flat by the filter coefficient adjust signals $SF_1$ to $SF_k$. That is, the gains of the equalizers $EQ_1$ to $EQ_k$ are set to 0 dB over the full audio frequency band. Also, the attenuation factors of the channel-to-channel attenuators $ATG_1$ to $ATG_k$ are set to 0 dB, and the delay times of all delay circuits $DLY_1$ to $DLY_k$ are set to 0, and the amplification factors of the amplifiers $5_{FL}$ to $5_{WF}$ shown in FIG. 1 are set equal.

In addition, the switch elements $SW_{12}$, $SW_{22}$, $SW_{32}$, $SW_{42}$, $SW_{52}$, $SW_{k2}$ are turned OFF (nonconductive) to cut off the input from the sound source 1, and the switch elements $SW_N$ is turned ON (conductive). Accordingly, the signal processing circuit 2 is set to the state that the noise signal (pink noise) DN generated by the noise generator 3 is supplied to the equalizers $EQ_1$ to $EQ_k$.

Then, in step S102, in case the listener selects the desired target curve, the frequency characteristics of the equalizers $EQ_1$ to $EQ_k$ are set based on the target curve data [TGx]. In contrast, in case the listener does not select the target curve, the frequency characteristics of the equalizers $EQ_1$ to $EQ_k$ are set, as they are, to those in above initialization process.

As indicated by a matrix in following Eq. (1), the target curve data [TGx] consist of a plurality of data $TG_1$ to $TG_k$ for respective channels x (=1 to k), and are provided in plural to respond to types of the music such as the classic, the rock music, etc. The listener can select the target curve every channel or select in answer to the type of the music such as the classic, the rock music, etc. by operating a remote controller.

$$[TGx] = \begin{pmatrix} TG1 \\ TG2 \\ TG3 \\ TG4 \\ TG5 \\ TGk \end{pmatrix} \tag{1}$$

Then, the process goes to step S104, and flag data n=0 is set in a flag register (not shown) built in the system controller MPU.

Then, the sound field characteristic measuring process is executed in step S106.

In this step, the noise signal DN is supplied in sequence to the first to k-th channels by exclusively turning ON the switch elements $SW_{11}$, $SW_{21}$, $SW_{31}$, $SW_{41}$, $SW_{51}$, $SW_{k1}$ for the predetermined period T respectively Accordingly, the microphone 8 collects the noise sound that is produced in sequence by respective loudspeakers 6FL to 6WF on the first to k-th channels. Then, the sound collecting data DM are supplied to the frequency characteristic correcting portion 11.

In addition, the sound collecting data DM for respective channels are frequency-divided by the band-pass filter 11*a* and then supplied to the gain calculating portion 11*c*. Therefore, data [PxJ] represented by a matrix in following Eq. (2) are supplied to the gain calculating portion 11*c*.

$$[PxJ] = \begin{pmatrix} P11 & \dots & P1j \\ P21 & \dots & P2j \\ P31 & \dots & P3j \\ P41 & \dots & P4j \\ P51 & \dots & P5j \\ Pk1 & \dots & Pki \end{pmatrix} \tag{2}$$

Then, in step S108, the gain calculating portion 11*c* spectrum-analyzes the data [PxJ] for respective channels. Then, in step S110, the gains of the equalizers $EQ_1$ to $EQ_k$ are calculated based on these spectrum-analyzed results. Accordingly, gain data [G0xJ] represented by a matrix in following Eq. (3) are calculated and then supplied to the coefficient deciding portion 11*d*.

$$[G0xJ] = \begin{pmatrix} G0(1,1) & \cdots & G0(1,j) \\ G0(2,1) & \cdots & G0(2,j) \\ G0(3,1) & \cdots & G0(3,j) \\ G0(4,1) & \cdots & G0(4,j) \\ G0(5,1) & \cdots & G0(5,j) \\ G0(k,1) & \cdots & G0(k,i) \end{pmatrix} \quad (3)$$

(3)

In this case, in above Eq. (3), a suffix 0 of the gain data [G0xJ] denotes the flag data n (=0), x denotes the number of the channel, and J denotes the order 1 . . . i . . . j of the frequencies set in the equalizers $EQ_1$ to $EQ_k$.

In addition, in step S108, the gain data [G0xJ] are compared with predetermined threshold value $THD_{CH}$ every channel, and sizes of the loudspeakers $\mathbf{6}_{FL}$ to $\mathbf{6}_{WF}$ on respective channels are decided based on the comparison results. That is, since the sound pressure of the reproduced sound reproduced by the loudspeaker is changed according to the size of the loudspeaker, the sizes of the loudspeakers on respective channels are decided.

As the concrete deciding means, if the size of the loudspeaker $\mathbf{6}_{FL}$ on the first channel is decided, an average value of the gain data G0 (1,1) to G0 (1,j) on the first channel in above Eq. (3) is compared with the threshold value $THD_{CH}$. If the average value is smaller than the threshold value $THD_{CH}$, the loudspeaker $\mathbf{6}_{FL}$ is decided as the small loudspeaker. Then, if the average value is larger than the threshold value $THD_{CH}$, the loudspeaker $\mathbf{6}_{FL}$ is decided as the large loudspeaker. In addition, the loudspeakers $\mathbf{6}_{FR}$, $\mathbf{6}_{C}$, $\mathbf{6}_{RL}$, $\mathbf{6}_{RR}$, $\mathbf{6}_{WF}$ on remaining channels are similarly decided.

Then, in step S112, it is decided whether or not the flag data n is 1. If NO, the flag data n is set to 1 in step S114, and then the process goes to step S116.

In step S116, the coefficient deciding portion 11*d* acquires the filter coefficient data from the coefficient table 11*e* based on the gain data [G0xJ], and then adjusts the frequency characteristic of the equalizers $EQ_1$ to $EQ_k$ by the filter coefficient adjust signals SF1 to $SF_k$.

Also, in above step S108, in case the channel in which the small loudspeaker is connected is decided, the frequency characteristic of the equalizer on the channel is adjusted to 0 dB. The frequency characteristic of the equalizer on the channel in which the large loudspeaker is connected is adjusted based on the filter coefficient data obtained according to the above gain data [G0xJ].

In the present embodiment, the size of the loudspeaker is decided by comparing the gain data [G0xJ] with the threshold value THDCH. But the size of the loudspeaker may be decided by comparing the data [PxJ] obtained in the sound field characteristic measuring process in step S106 with the threshold value.

Then, after the process in step S116, the processes starting from step S106 are repeated.

In this manner, the processes in step S106 and subsequent steps are repeated. In step S112, if it is decided that the flag data n is 1, the process goes to step S118.

If the processes in step S104 and subsequent steps are repeated, the flag data n is set to n=1 and thus the calculations in above Eqs. (2) (3) are executed once again. Thus, the gain data [G1xJ] represented by a matrix in following Eq. (4) corresponding to above Eq. (3) are calculated. In this case, a suffix 1 of the gain data [G1xJ] denotes the flag data n (=1), x denotes the number of the channel, and J denotes the order 1 . . . i . . . j of the frequencies being set in the equalizers $EQ_1$ to $EQ_k$.

$$[G1xJ] = \begin{pmatrix} G1(1,1) & \cdots & G1(1,j) \\ G1(2,1) & \cdots & G1(2,j) \\ G1(3,1) & \cdots & G1(3,j) \\ G1(4,1) & \cdots & G1(4,j) \\ G1(5,1) & \cdots & G1(5,j) \\ G1(k,1) & \cdots & G1(k,i) \end{pmatrix} \quad (4)$$

Then, in step S118, the gain calculating portion 11*c* adds the gain data [G0xJ] and [G1xJ] on above Eqs. (3) (4) for respective rows and columns to calculate the optimum gain data $[GxJ]_{opt}$ represented by a matrix in following Eq. (5), and supplies them to the coefficient deciding portion 11*d*.

$$[GxJ]opt = \begin{pmatrix} G0(1,1)+G1(1,1) & \cdots & G0(1,j)+G1(1,j) \\ G0(2,1)+G1(2,1) & \cdots & G0(2,j)+G1(2,j) \\ G0(3,1)+G1(3,1) & \cdots & G0(3,j)+G1(3,j) \\ G0(4,1)+G1(4,1) & \cdots & G0(4,j)+G1(4,j) \\ G0(5,1)+G1(5,1) & \cdots & G0(5,j)+G1(5,j) \\ G0(k,1)+G1(k,1) & \cdots & G0(k,j)+G1(k,j) \end{pmatrix} \quad (5)$$

In addition, the coefficient deciding portion 11*d* acquires the filter coefficient data from the coefficient table 11*e* based on the gain data $[GxJ]_{opt}$. Then, in step S120, the frequency characteristics of the equalizers $EQ_1$ to $EQ_k$ are finally adjusted by the filter coefficient adjust signals $SF_1$ to $SF_k$ based on the filter coefficient data.

In this way, the frequency characteristic of the sound field space is corrected by adjusting the frequency characteristics of the equalizers $EQ_1$ to $EQ_k$ by virtue of the frequency characteristic correcting portion 11.

Also, in the sound field characteristic measuring process in step S106, since respective loudspeakers $\mathbf{6}_{FL}$, $\mathbf{6}_{FR}$, $\mathbf{6}_{C}$, $\mathbf{6}_{RL}$, $\mathbf{6}_{RR}$, $\mathbf{6}_{WF}$ are sounded by the frequency-divided pink noise and then resultant reproduced sounds are collected, the frequency characteristics and the reproducing capabilities (output powers) of respective loudspeakers can be detected. Therefore, the total rationalization of the frequency characteristic can be achieved while taking account of the frequency characteristics and the reproducing capabilities of respective loudspeakers.

Next, the channel-to-channel level correcting process in step S20 will be carried out. Such channel-to-channel level correcting process will be carried out in compliance with a flowchart shown in FIG. 10.

First, the initialization process in step S200 is executed, and the noise signal DN from the noise generator 3 can be input by switching the switch elements $SW_{11}$ to $SW_{51}$. At this time, the switch elements $SW_{11}$, $SW_{k2}$ on the k-th channel are turned OFF. Also, the attenuation factors of the channel-to-channel attenuators $ATG_1$ to $ATG_k$ are set to 0 dB. In addition, the delay times of all delay circuits $DLY_1$ to $DLY_5$ are set to 0. Further, the amplification factors of the amplifiers $\mathbf{5}_{FL}$ to $\mathbf{5}_{WF}$ shown in FIG. 1 are made equal.

Besides, the frequency characteristic of the graphic equalizers GEQ is fixed to the state that they have been adjusted by the above frequency characteristic correcting process.

Then, in step S202, the variable x representing the channel number is set to 1. Then, in step S204, the sound field characteristic measuring process is executed. The processes in steps S204 to S208 are repeated until the sound field characteristic measurement of the channels 1 to 5 is completed.

Here, the noise signal (pink noise) is supplied in sequence to the equalizers $EQ_1$ to $EQ_k$ by exclusively turning ON the switch elements $SW_{11}$, $SW_{21}$, $SW_{31}$, $SW_{41}$, $SW_{51}$ for the predetermined period T respectively (steps S206, S208).

The microphone 8 collects respective reproduced sounds being reproduced by the loudspeakers $\mathbf{6}_{FL}$, $\mathbf{6}_{FR}$, $\mathbf{6}_{C}$, $\mathbf{6}_{RL}$, $\mathbf{6}_{RR}$ by this repeating process. Then, resultant sound collecting data DM (=$DM_1$ to $DM_5$) on respective channels are supplied to the channel-to-channel level correcting portion 12. That is, the sound collecting data [DMx] represented by the matrix in following Eq. (6) are supplied to the channel-to-channel level correcting portion 12.

$$[DBx] = \begin{pmatrix} DM1 \\ DM2 \\ DM3 \\ DM4 \\ DM5 \end{pmatrix} \tag{6}$$

Then, after the measurement of the sound field characteristics on the first to fifth channels has been finished, the process goes to step S210. Then, one sound collecting data having the minimum value is extracted from the above sound collecting data $DM_1$ to $DM_5$. Then, the extracted result is set as the target data $TG_{CH}$ for the channel-to-channel level correction.

Then, in step S212, adjusted values $DM_1/TG_{CH}$, $DM_2/TG_{CH}$, $DM_3/TG_{CH}$, $DM_4/TG_{CH}$, $DM_5/TG_{CH}$, used to adjust the attenuation factors of the channel-to-channel attenuators $ATG_1$ to $ATG_5$, are calculated by normalizing respective sound collecting data $DM_1$ to $DM_5$ in above Eq. (6) by the target data $TG_{CH}$. Then, in step S214, the attenuation factors of the channel-to-channel attenuators $ATG_1$ to $ATG_5$ are adjusted by using the adjust signals $SG_1$ to $SG_5$ based on these adjusted values $DM_1/TG_{CH}$ to $DM_5/TG_{CH}$.

With the above processes, the level adjustment between the first to fifth channels (x=1 to 5) except the k-th channel is completed.

In this fashion, the levels of the first to fifth channels are made proper by correcting the attenuation factors of the channel-to-channel attenuators $ATG_1$ to $ATG_k$ by virtue of the channel-to-channel level correcting portion 12.

Also, in the sound field characteristic measuring process in step S204, since resultant reproduced sounds are collected by sounding the loudspeakers $\mathbf{6}_{FL}$, $\mathbf{6}_{FR}$, $\mathbf{6}_{C}$, $\mathbf{6}_{RL}$, $\mathbf{6}_{RR}$ on time-division basis, the reproducing capabilities (output powers) of respective loudspeakers can be detected. Therefore, it is possible to achieve the total rationalization with taking account of the reproducing capabilities of respective loudspeakers.

Figure 11:
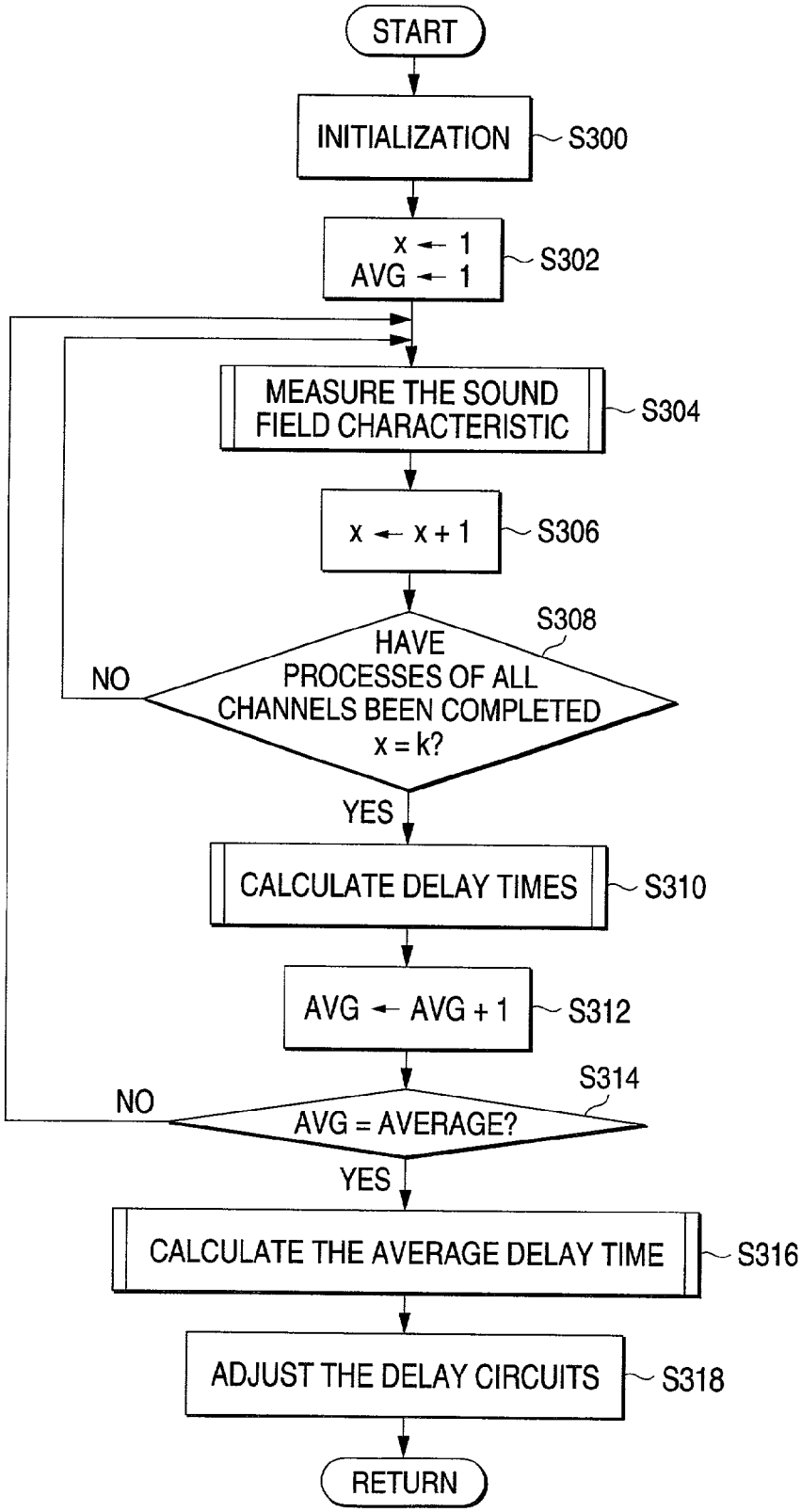
FIG. 11 is a flowchart showing a phase characteristic correcting process.

Next, the phase characteristic correcting process in step S30 will be carried out in compliance with a flowchart shown in FIG. 11.

First, the initialization process in step S300 is executed. The noise signal (pink noise) DN output from the noise generator 3 can be input by switching the switch elements $SW_{11}$ to $SW_{k2}$. Also, the frequency characteristics of the equalizers $EQ_1$ to $EQ_k$ are fixed to the already-adjusted characteristics as they are, and the attenuation factors of the channel-to-channel attenuators $ATG_1$ to $ATG_k$ are fixed as they are, and also the delay times of the delay circuits $DLY_1$ to $DLY_k$ are set to 0. Furthermore, the amplification factors of the amplifiers $\mathbf{5}_{FL}$ to $\mathbf{5}_{WF}$ shown in FIG. 1 are made equal.

Then, in step S302, the variable x representing the channel number is set to 1 and a variable AVG is set to 0. Then, in step S304, the sound field characteristic measuring process is carried out to measure the delay times. Then, the processes in steps S304 to S308 are repeated until the sound field characteristic measurement of the first to k-th channels have been completed.

Here, the noise signal DN is supplied to the variable-gain filter portions $BPF_1$ to $BPF_5$ by exclusively turning ON the switch elements $SW_{11}$, $SW_{21}$, $SW_{31}$, $SW_{41}$, $SW_{k1}$ for the predetermined period T respectively.

According to this repeating process, the phase characteristic correcting portion 13 measures the noise sounds, that reach the listening position RV from the loudspeakers $\mathbf{6}_{FL}$ to $\mathbf{6}_{WF}$, as the sound collecting data DM.

When this measurement has been completed, the process goes to step S310 wherein the phase characteristics of respective channels are calculated. Here, the cross correlation between the sound collecting data DM measured when the noise signal DN is supplied to the first channel, i.e., a plurality of sound collecting data DM measured within the period T is calculated.

Then, a peak interval (phase difference) between resultant correlation values by the calculation is set as a delay time $\tau\mathbf{1}$ of the first channel. Also, the delay times $\tau\mathbf{2}$ to $\tau k$ are detected by calculating above similar cross correlations between the second to k-th channels.

Then, the process goes to step S312 wherein the variable AVG is incremented by 1. Then, in step S314, it is decided whether or not the variable AVG reaches a predetermined value AVERAGE. If NO, the processes starting from step S304 are repeated.

Here, the predetermined value AVERAGE is a constant indicating the number of times of the repeating processes in steps S304 to S312. In the present embodiment, the predetermined value AVERAGE is set to AVERAGE=4.

The delay times $\tau\mathbf{1}$ to $\tau k$ of respective channels are calculated for every four channels by repeating the four times measuring process in this manner.

Then, in step S316, respective average values of every four delay times $\tau\mathbf{1}$ to $\tau k$ are calculated. These average values $\tau\mathbf{1}'$ to $\tau k'$ of respective delay times are set finally as the delay times.

Then, in step S318, the delay times of the delay circuits $DLY_1$ to $DLY_k$ are adjusted by the adjust signals $SDL_1$ to $SDL_k$ based on the finally calculated delay times $\tau\mathbf{1}'$ to $\tau k'$, whereby the phase characteristic correcting process has been completed.

In this manner, in the phase characteristic correcting process, the loudspeakers are sounded by supplying the pink noise from the graphic equalizer GEQ side, and then the delay times are calculated from the sound collecting results of resultant reproduced sounds. Therefore, the delay times of the delay circuits $DLY_1$ to $DLY_k$ are not simply adjusted (corrected) based on only the propagation delay times of the reproduced sounds, but it is possible to implement the total rationalization while taking account of the reproducing capabilities of respective loudspeakers and the characteristic of the audio system.

Figure 12:
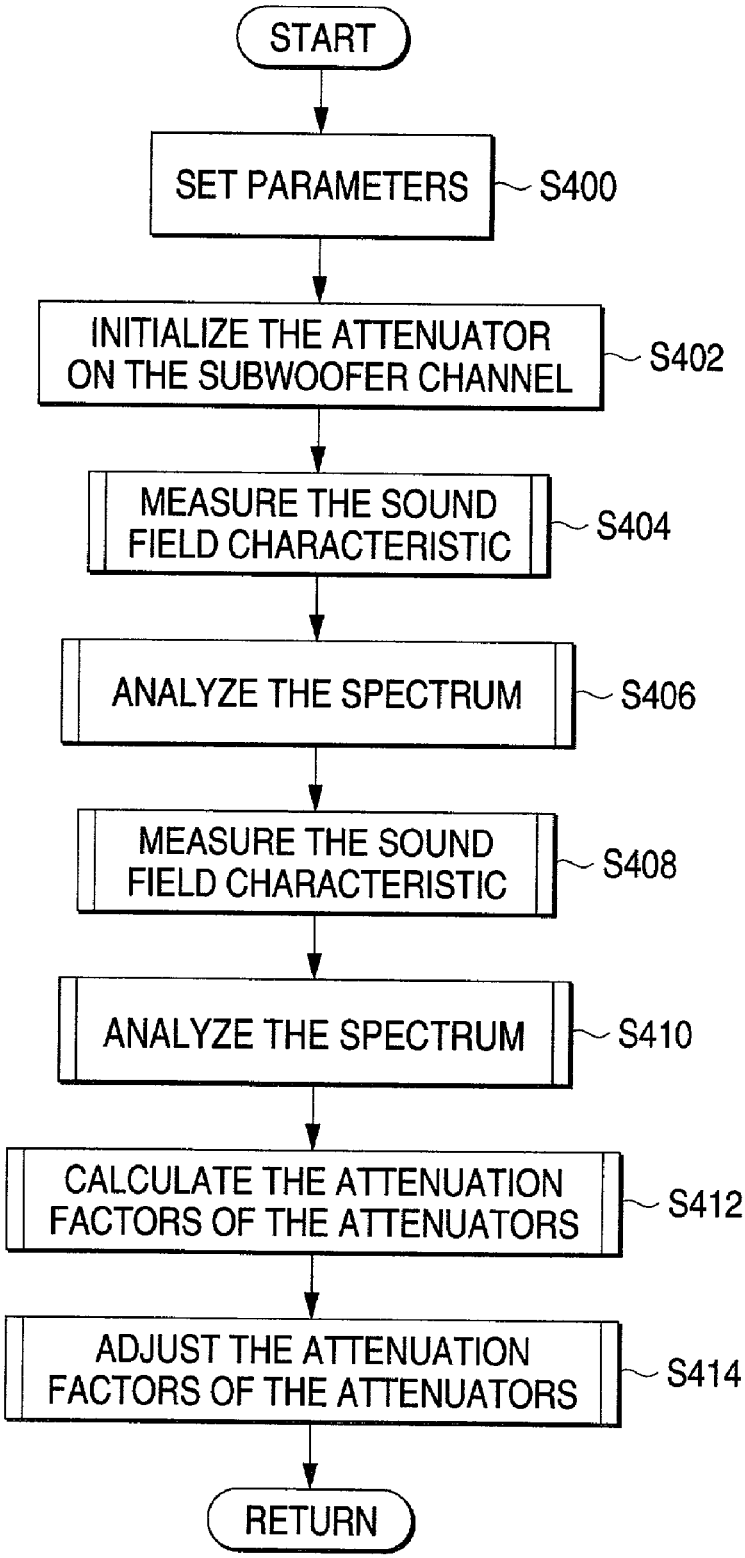
FIG. 12 is a flowchart showing a flatness correcting process.

Next, the process in step S40 will be carried out in compliance with a flowchart shown in FIG. 12.

First, in step S400, the noise signal (uncorrelated noise) DN output from the noise generator 3 can be input by switching the switch elements $SW_{11}$ to $SW_{k1}$. Also, the frequency characteristics of the variable gain filter portion $BPF_1$ to $BPF_5$ are fixed to the already-adjusted characteristics, and the attenuation factors of the channel-to-channel attenuators $ATG_1$ to $ATG_k$ are also fixed as they are. Then, the delay times of the delay circuits DLY1 to DLYk are fixed to the already-adjusted delay times. Further, the amplification factors of the amplifiers $\mathbf{5}_{FL}$ to $\mathbf{5}_{WF}$ shown in FIG. 1 are made equal.

Then, in step S402, the attenuation factor of the channel-to-channel attenuator $ATG_k$ on the k-th channel is set to 0 dB.

Then, in step S404, the noise signal (uncorrelated noise) DN is simultaneously supplied to the first to fifth channels except the k-th channel.

Accordingly, the all frequency band loudspeakers $\mathbf{6}_{FL}$, $\mathbf{6}_{FR}$, $\mathbf{6}_{C}$, $\mathbf{6}_{RL}$, $\mathbf{6}_{RR}$ are simultaneously sounded by the noise signal DN in the all frequency band, and then the flatness correcting portion 14 receives resultant sound collecting data DM.

In step S406, the flatness correcting portion 14 calculates the power spectrum $P_L$ of the reproduced sound reproduced in the low frequency band by the all frequency band loudspeakers $\mathbf{6}_{FL}$ to $\mathbf{6}_{RR}$ and the power spectrum $P_{MH}$ of the reproduced sound in the middle/high frequency band by spectrum-analyzing the sound collecting data DM.

Then, in step S408, the noise signal (pink noise) DN is supplied only to the k-th channel.

Accordingly, only the low frequency band exclusively reproducing loudspeaker $\mathbf{6}_{WF}$ is sounded by the noise signal DN in the low frequency band, then the flatness correcting portion 14 receives resultant sound collecting data DM in the low frequency band.

Then, in step S410, the flatness correcting portion 14 calculates the reproduced sound power $P_{WFL}$ reproduced by the low frequency band exclusively reproducing loudspeaker $\mathbf{6}_{WF}$ in the low frequency band by spectrum-analyzing the sound collecting data DM in the low frequency band.

Then, in step S412, the flatness correcting portion 14 generates the adjust signal $SG_k$ by executing the calculation expressed by following Eq. (7) to adjust the attenuation factor of the channel-to-channel attenuator $ATG_k$.

$$SGk=(TG_L \times P_{MH}-TG_{MH} \times P_L)/TG_{MH} \times P_{WFL} \quad (7)$$

A coefficient $TG_{MH}$ in above Eq. (7) is an average value of the target curve data corresponding to the middle/high frequency band, out of the target curve data which the listener selects among the target curve data [TGx] shown in above Eq. (1) or the default target curve data which the listener does not select. Also, a coefficient $TG_L$ is an average value of the target curve data corresponding to the low frequency band.

Then, in step S414, the attenuation factor of the channel-to-channel attenuator $ATG_k$ is adjusted by using the adjust signal $SG_k$, whereby the automatic sound field correcting process has been completed.

In this manner, in the case that the audio sound is reproduced by all frequency band loudspeakers $\mathbf{6}_{FL}$, $\mathbf{6}_{FR}$, $\mathbf{6}_{C}$, $\mathbf{6}_{RL}$, $\mathbf{6}_{RR}$, $\mathbf{6}_{WF}$, the frequency characteristic of the reproduced sound in the sound field space can be made flat over the full audio frequency range if the level correction is executed finally between the channels by the flatness correcting portion 13. Therefore, the problem in the prior art such as the increase of the low frequency band level shown in FIG. 6 can be overcome.

Also, in the sound field characteristic measuring process in steps S404 to S408, since the reproduced sounds generated by sounding respective loudspeakers $\mathbf{6}_{FL}$, $\mathbf{6}_{FR}$, $\mathbf{6}_{C}$, $\mathbf{6}_{RL}$, $\mathbf{6}_{RR}$, $\mathbf{6}_{WF}$ on time-division basis are collected, the reproducing capabilities (output power) of respective loudspeakers can be detected. Therefore, the total rationalization with taking the reproducing capabilities of respective loudspeakers into consideration can be achieved.

Then, the audio signals $S_{FL}$, $SF_{FR}$, $S_C$, $S_{RL}$, $S_{RR}$, $S_{WF}$ from the sound source 1 are set into the normal input state by turning OFF the switch element SWN, turning OFF the switch elements $SW_{11}$, $SW_{21}$, $SW_{31}$, $SW_{41}$, $SW_{51}$, $SW_{k1}$ connected to this switch element, and turning ON the switch elements $SW_{12}$, $SW_{22}$, $SW_{32}$, $SW_{42}$, $SW_{52}$, $SW_{k2}$, and thus the present audio system is brought into the normal audio playback state.

As described above, according to the present embodiment, since the characteristics of the sound field space at the listening position RV are corrected while totally taking account of the characteristics of the audio system and the loudspeakers, the extremely high quality sound field space with the presence can be provided.

Figure 8:
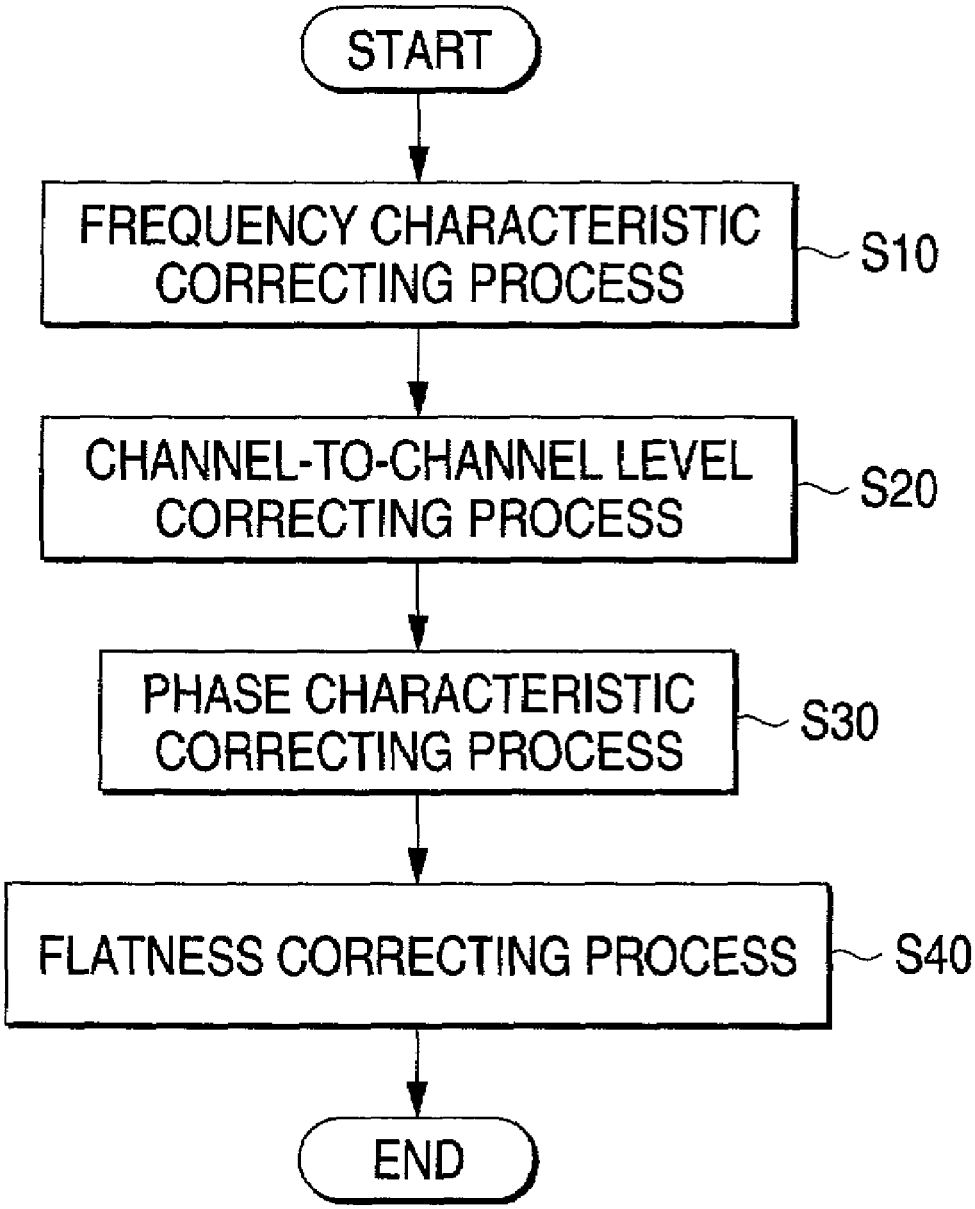
FIG. 8 is a flowchart showing an operation of the automatic sound field correcting system according to the present embodiment.
Figure 9:
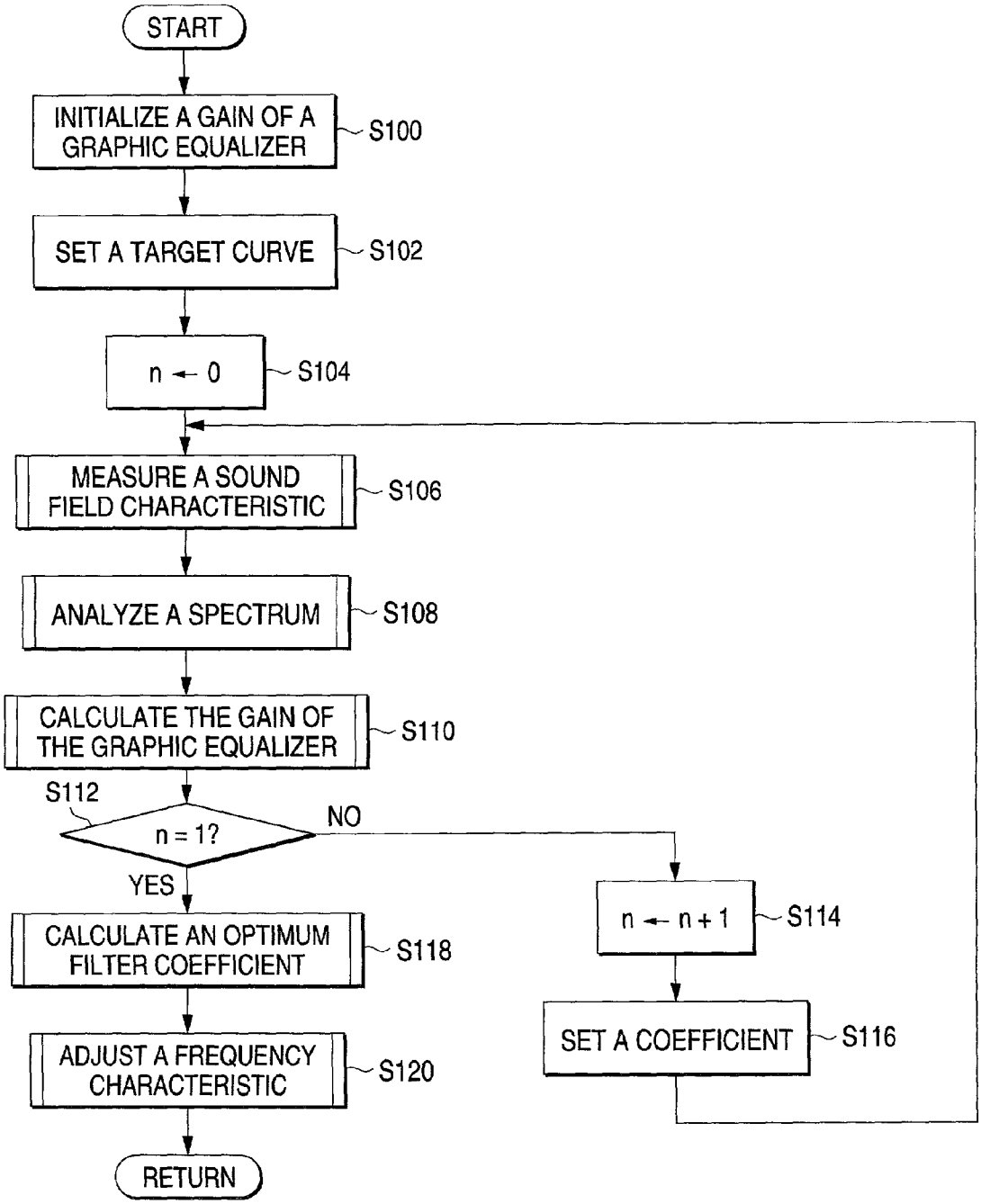
FIG. 9 is a flowchart showing a frequency characteristic correcting process.
Figure 10:
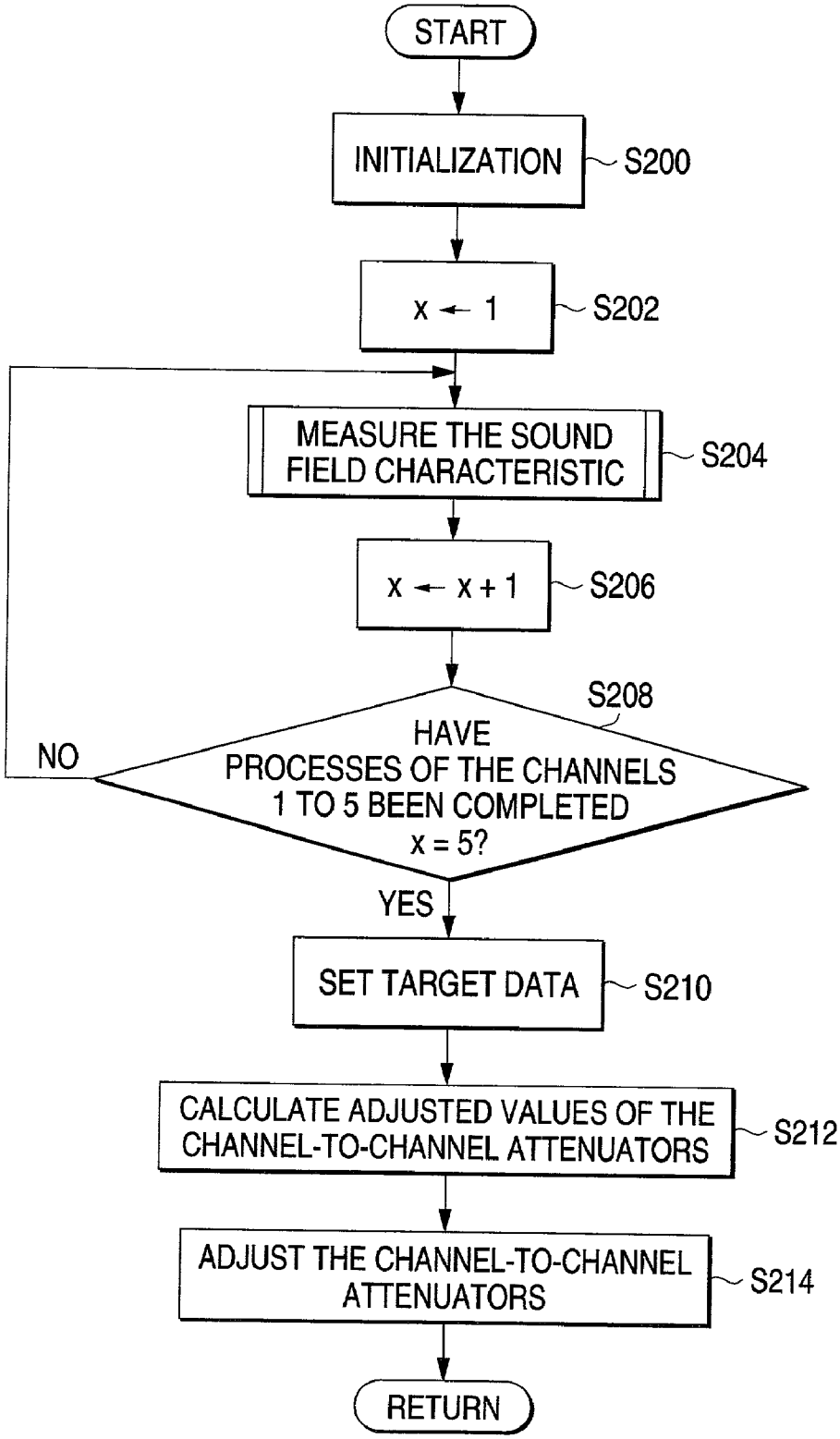
FIG. 10 is a flowchart showing a channel-to-channel level correcting process.

Also, the correction to implement the very high quality sound field space with the presence is made possible by executing the sound field correcting process in the order of steps S10 to S40 shown in FIG. 8.

In the present embodiment, the automatic sound field correcting system of the so-called 5.1 channel multi-channel audio system that includes the wide frequency range loudspeakers $\mathbf{6}_{FL}$ to $\mathbf{6}_{RR}$ for five channels and the low frequency band exclusively reproducing loudspeaker $\mathbf{6}_{WF}$ has been explained, but the present invention is not limited to this. The automatic sound field correcting system of the present invention can be applied to the multi-channel audio system that includes the loudspeakers that are larger in number than the present embodiment. Also, the automatic sound field correcting system of the present invention can be applied to the audio system that includes the loudspeakers that are smaller in number than the present embodiment.

The sound field correction in the audio system including the low frequency band exclusively reproducing loudspeaker (subwoofer) $\mathbf{6}_{WF}$ has been explained, but the present invention is not limited to this. The high quality sound field space with the presence can be provided by the audio system including only the all frequency band loudspeakers without the subwoofer. In this case, all channel characteristics may be corrected by the channel-to-channel level correcting portion 12 not to use the flatness correcting portion 14.

In the present embodiment, in step S412 shown in FIG. 12, as apparent from above Eq. (7), the rationalization of the attenuation factor of the channel-to-channel attenuator $ATG_k$ is performed on the basis of the levels of the reproduced sounds of all frequency band loudspeakers $\mathbf{6}_{FL}$ to $\mathbf{6}_{RR}$. That is, the levels of the reproduced sounds of all frequency band loudspeakers $\mathbf{6}_{FL}$ to $\mathbf{6}_{RR}$ are used as the basis by setting a product of the target data $TG_{MH}$ in the middle/high frequency band and the variable $P_{WFL}$, that corresponds to the level of the reproduced sound of the low frequency band exclusively reproducing loudspeaker $\mathbf{6}_{WF}$, in the denominator of above Eq. (7). However, the present invention is not limited to this. The rationalization of the attenuation factors of the channel-to-channel attenuators $ATG_1$ to $ATG_5$ is performed on the basis of the level of the reproduced sound of the low frequency band exclusively reproducing loudspeaker $6_{WF}$.

That is, in the present embodiment, the flatness correcting portion 14 corrects the attenuation factor of the channel-to-channel attenuator $ATG_k$. Conversely, the level of the reproduced sound of the low frequency band exclusively reproducing loudspeaker $6_{WF}$ may be measured, then the attenuation factor of the channel-to-channel attenuator $ATG_k$ may be set on the basis of measured result, and then the attenuation factors of the channel-to-channel attenuators $ATG_1$ to $ATG_5$ may be corrected on the basis of the attenuation factor of the channel-to-channel attenuator $ATG_k$.

Further, as shown in FIG. 2, each of the signal transmission lines of respective channels are constructed by connecting the band-pass filters, the inter-band attenuators, the adder, the channel-to-channel attenuator, and the delay circuit in sequence following to the graphic equalizer GEQ. However, such configuration is shown as the typical example and thus the present invention is not limited to such configuration.

For example, the channel-to-channel attenuator $ATG_1$ to $ATG_k$ and the delay circuit $DLY_1$ to $DLY_k$ may be arranged prior to the graphic equalizer GEQ, otherwise the graphic equalizer GEQ may be arranged between the channel-to-channel attenuator $ATG_1$ to $ATG_k$ and the delay circuit $DLY_1$ to $DLY_k$.

The reasons for enabling the configuration of the present invention to change appropriately the positions of the constituent elements are that, unlike the conventional audio system in which the correction of the frequency characteristic and the correction of the phase characteristic are performed respectively by separating respective constituent elements, the noise signal from the noise generator can be input from the input stage of the sound field correcting system and also the frequency characteristic and the phase characteristic of the overall sound field correcting system can be corrected totally. As a result, the automatic sound field correcting system of the present invention makes it possible to correct properly the frequency characteristic and the phase characteristic of the overall audio system and to enhance margin in design.

Also, upon correcting the attenuation factors of the channel-to-channel attenuators by the flatness correcting portion 14, the pink noise is supplied from the noise generator 3 to the loudspeaker $6_{WF}$. But other noises may be supplied.

As described above, according to the automatic sound field correcting system according to the present invention, since the sound field correction is performed while taking totally account of the characteristics of the audio system and the loudspeakers, the extremely high quality sound field space with the presence can be provided.

Also, in the audio system including the low frequency band exclusively reproducing loudspeaker and wide frequency band loudspeakers, since a new function for making the level of the low frequency band reproduced sound and the level of the middle/high frequency band reproduced sound equal is provided, the extremely high quality sound field space with the presence can be provided.

What is claimed is:

1. An automatic sound field correcting system in an audio system for supplying a plurality of input audio signals to a plurality of sound generating means via a plurality of signal transmission lines, each of the plurality of signal transmission lines including an equalizer for adjusting a frequency characteristic of the audio signal, a channel-to-channel level adjusting means for adjusting a level of the audio signal, and a delaying means for adjusting a delay time of the audio signal, so that the input audio signals are supplied to said sound generating means via said equalizers, said channel-to-channel level adjusting means, and said delaying means, said correcting system comprising:

a noise generating means for supplying a noise to respective signal transmission lines independently in correcting a sound field;

detecting means for detecting reproduced sounds of the noise reproduced by said sound generating means;

frequency characteristic correcting means for correcting frequency characteristics of the equalizers based on detection results of said detecting means;

channel-to-channel level correcting means for correcting an adjusted amount of said plurality of channel-to-channel level adjusting means based on the detection results of said detecting means, wherein the channel-to-channel level correcting means corrects the adjusted amount of said plurality of channel-to-channel level adjusting means based on one data of sound collecting data, said one data of the sound collecting data having a minimum value with respect to at least one other data of the sound collecting data; and phase characteristic correcting means for calculating phase characteristics of the reproduced sounds reproduced by said sound generating means based on the detection results of said detecting means and also correcting delay times of said delaying means based on calculated phase characteristics, wherein a size of said sound generating means is determined by comparing gain data with a threshold.

2. The automatic sound field correcting system according to claim 1, further comprising:

a controlling means for causing said channel-to-channel level correcting means to correct an adjusted amount of said channel-to-channel level adjusting means and causing said phase characteristic correcting means to correct the delay times of said delaying means, after causing said frequency characteristic correcting means to correct the adjusted amount of said equalizers.

3. The automatic sound field correcting system according to claim 1, wherein said noise generating means supplies a pink noise as the noise to said equalizers.

4. The automatic sound field correcting system according to claim 2, wherein said channel-to-channel level correcting means corrects respective adjusted amounts of said plurality of channel-to-channel level adjusting means such that levels of reproduced sounds reproduced by said plurality of sound generating means is made substantially equal over a full audio frequency band.

5. An automatic sound field correcting system in an audio system for supplying a plurality of input audio signals to all frequency band sound generating means and a low frequency band exclusively reproducing sound generating means via a plurality of signal transmission lines, each of the plurality of signal transmission lines including an equalizer for adjusting a frequency characteristic of the audio signal, a channel-to-channel level adjusting means for adjusting a level of the audio signal, and a delaying means for adjusting a delay time of the audio signal, so that the input audio signals are supplied to said sound generating means via said equalizers, said channel-to-channel level adjusting means, and said delaying means, said correcting system comprising:

a noise generating means for supplying a noise to said respective signal transmission lines independently in correcting a sound field;

detecting means for detecting reproduced sounds of the noise reproduced by said sound generating means;

frequency characteristic correcting means for correcting frequency characteristics of said equalizers based on detection results of said detecting means;

first channel-to-channel level correcting means for correcting an adjusted amount of said plurality of channel-to-channel level adjusting means of the signal transmission lines, in which the all frequency band sound generating means are provided, out of said plurality of channel-to-channel level adjusting means based on the detection results of said detecting means;

phase characteristic correcting means for calculating phase characteristics of the reproduced sounds reproduced by respective sound generating means based on the detection results of said detecting means and also correcting delay times of said delaying means based on calculated phase characteristics; and second channel-to-channel level correcting means for correcting an adjusted amount of the plurality of channel-to-channel level adjusting means of the signal transmission lines, in which the low frequency band exclusively reproducing sound generating means are provided, based on the detection results of said detecting means, wherein the first channel-to-channel level correcting means and the second channel-to-channel level correcting means correct the adjusted amount of said plurality of channel-to-channel level adjusting means based on one data of the sound collecting data, said one data of the sound collecting data having a minimum value with respect to at least one other data of the sound collecting data, wherein a size of said sound generating means is determined by comparing gain data with a threshold.

6. The automatic sound field correcting system according to claim 5, further comprising:

controlling means for causing said first channel-to-channel level correcting means to perform the correction, then causing said phase characteristic correcting means to perform the correction, and then causing said second channel-to-channel level correcting means to perform the correction after causing said frequency characteristic correcting means to perform the correction.

7. The automatic sound field correcting system according to claim 5, wherein said second channel-to-channel level correcting means corrects an adjusted amount of said channel-to-channel level adjusting means such that a sum of a spectrum average level of the reproduced sound reproduced by all frequency band sound generating means in a low frequency band and a spectrum average level of the reproduced sound reproduced by a low frequency band exclusively reproducing sound generating means in the low frequency band and a spectrum average level of the reproduced sound in a middle/high frequency band reproduced by the all frequency band sound generating means are set equal to a ratio of target curve data.

8. The automatic sound field correcting system according to claim 1 or 5, wherein said phase characteristic correcting means calculates phase characteristics of the reproduced sounds based on detection results of said detecting means by a correlation calculating approach.

9. A sound field correcting method in an audio system including a plurality of signal transmission lines for supplying a plurality of input audio signals separately to all frequency band sound generating means and a low frequency band exclusively reproducing sound generating means, each of the plurality of signal transmission lines including an equalizer for adjusting a frequency characteristics of the audio signal, a channel-to-channel level adjusting means for adjusting a level of the audio signal, and a delaying means for adjusting a delay time of the audio signal, so that the input audio signals are supplied to said sound generating means via said equalizers, said channel-to-channel level adjusting means, and said delaying means, said method comprising:

a first step of measuring reproduced sounds reproduced by said all frequency band sound generating means and a low frequency band exclusively reproducing sound generating means by inputting a noise, and then correcting frequency characteristics of said equalizers based on measured results;

a second step of measuring the reproduced sounds reproduced by said all frequency band sound generating means and said low frequency band exclusively reproducing sound generating means by inputting the noise, and then correcting an adjusted amount of said channel-to-channel level adjusting means for said all frequency band sound generating means based on the measured results;

a third step of measuring the reproduced sounds reproduced by said all frequency band sound generating means and said low frequency band exclusively reproducing sound generating means by inputting the noise, and then correcting delay times of said delaying means based on the measured results;

a fourth step of measuring independently reproduced sounds reproduced by said all frequency band sound generating means and reproduced sounds reproduced by said low frequency band exclusively reproducing sound generating means; and a fifth step of correcting an adjusted amount of said channel-to-channel level adjusting means based on measured results measured by the fourth step such that a sum of a spectrum average level of the reproduced sounds reproduced by said all frequency band sound generating means in a low frequency band and a spectrum average level of the reproduced sound reproduced by said low frequency band exclusively reproducing sound generating means in the low frequency band and a spectrum average level of the reproduced sound reproduced by said all frequency band sound generating means in a middle/high frequency band are set equal to a ratio of target curve data, wherein the adjusted amount of said channel-to-channel level adjusting means is corrected based on one data of the sound collecting data, said one data of the sound collecting data having a minimum value with respect to at least one other data of the sound collecting data, wherein a size of said sound generating means is determined by comparing gain data with a threshold.

10. The sound field correcting method according to claim 9, wherein measurement of the reproduced sounds in the first step is performed at plural times, and then the frequency characteristics of said equalizers are corrected based on plural times measured results.

11. The sound field correcting method according to claim 9, wherein measurement of the reproduced sounds in the second step is performed at plural times, and then the adjusted amount of said channel-to-channel level adjusting means is corrected based on plural times measured results.

12. The sound field correcting method according to claim 9 or 10, wherein the frequency characteristics of said equalizers are corrected based on multiplied results of the measured result and the target curve data in the first step.

13. An automatic sound field correcting system in an audio system which supplies a plurality of input audio signals to a plurality of sound generators via a plurality of signal transmission lines each comprising an equalizer, a channel-to-channel attenuator, and a delay circuit, said sound field correcting system comprising:

a noise signal generator which independently supplies a noise signal to respective signal transmission lines;

a sound detection circuit which detects sounds of noise signals reproduced by said sound generators;

a frequency characteristic correcting circuit which corrects frequency characteristics of said equalizer of each of said signal transmission lines based on a detection result of said sound detection circuit;

a channel-to-channel level correcting circuit which corrects an adjusted amount of said channel-to-channel attenuator of each of said signal transmission lines based on the detection result of said sound detecting circuit, wherein the channel-to-channel level correcting circuit corrects the adjusted amount of said channel-to-channel attenuator based on one data of sound collecting data, said one data of the sound collecting data having a minimum value with respect to at least one other data of the sound collecting data; and a phase characteristic correcting circuit which calculates phase characteristics of the reproduced sounds reproduced by said sound generators based on the detection results of said sound detecting circuit, said phase characteristic correcting circuit correcting delay times of said delay circuit of each of said signal transmission lines based on said calculated phase characteristics, wherein a size of said sound generators is determined by comparing gain data with a threshold.

14. The automatic sound field correcting system according to claim 13, further comprising:

a control circuit which controls said channel-to-channel level correcting circuit to correct said adjusted amount of said channel-to-channel attenuator of each of said signal transmission lines, and controls said phase characteristic correcting circuit to correct the delay times of said delay circuit of each of said signal transmission lines, after controlling said frequency characteristic correcting circuit to correct the adjusted amount of said equalizer of each of said signal transmission lines.

15. The automatic sound field correcting system according to claim 13, wherein said noise signal generator supplies a pink noise as the noise to said equalizer of each of said signal transmission lines.

16. The automatic sound field correcting system according to claim 14, wherein said channel-to-channel level correcting circuit corrects respective adjusted amounts of said channel-to-channel attenuator of each of said signal transmission lines such that levels of reproduced sounds reproduced by said plurality of sound generators is made substantially equal over a full audio frequency band.

17. An automatic sound field correcting system in an audio system which supplies a plurality of input audio signals to a plurality of sound generators via a plurality of signal transmission lines each comprising an equalizer, a channel-to-channel attenuator, and a delay circuit, said sound generators comprising at least one first sound generator which generates an all frequency band sound and at least one second sound generator which generates a low frequency band sound exclusively, said sound field correcting system comprising:

a noise signal generator which independently supplies a noise signal to respective signal transmission lines;

a sound detection circuit which detects sounds of the noise signals reproduced by said sound generators;

a frequency characteristic correcting circuit which corrects frequency characteristics of said equalizer of each of said signal transmission lines based on a detection result of said sound detection circuit;

a first channel-to-channel level correcting circuit which corrects an adjusted amount of said channel-to-channel attenuator of each of said signal transmission lines having said at least one first sound generator, based on the detection result of said sound detection circuit;

a phase characteristic correcting circuit which calculates phase characteristics of the reproduced sounds reproduced by said sound generators based on the detection results of said sound detection circuit, said phase characteristic correcting circuit correcting delay times of said delay circuit of each of said signal transmission lines based on said calculated phase characteristics; and second channel-to-channel level correcting circuit which corrects an adjusted amount of said channel-to-channel attenuator of each of said signal transmission lines having said at least one second sound generator, based on the detection result of said sound detection circuit, wherein the first channel-to-channel level correcting circuit and the second channel-to-channel level correcting circuit correct the adjusted amount of said plurality of channel-to-channel level attenuator based on one data of the sound collecting data, said one data of the sound collecting data having a minimum value with respect to at least one other data of the sound collecting data, wherein a size of said sound generators is determined by comparing gain data with a threshold.

18. The automatic sound field correcting system according to claim 17, further comprising:

a control circuit which controls said first channel-to-channel level correcting circuit to corrects said adjusted amount of said channel-to-channel attenuator of each of said signal transmission lines having said at least one first sound generator, then controls said phase characteristic correcting circuit to correct said delay times of said delay circuit of each of said signal transmission lines, and then controls said second channel-to-channel level correcting circuit to correct said adjusted amount of said channel-to-channel attenuator of each of said signal transmission lines having said at least one second sound generator after causing said frequency characteristic correcting circuit to correct said frequency characteristics of said equalizer of each of said signal transmission lines.

19. The automatic sound field correcting system according to claim 17, wherein said second channel-to-channel level correcting circuit corrects said adjusted amount of said channel-to-channel attenuator of each of said signal transmission lines having said at least one second sound generator such that a sum of a spectrum average level of the reproduced sound in a low frequency band reproduced by said at least one first sound generator, a spectrum average level of the reproduced sound in the low frequency band reproduced by said at least one second sound generator, and a spectrum average level of the reproduced sound in a middle/high frequency band reproduced by said at least one first sound generator are set equal to a ratio of target curve data.

20. The automatic sound field correcting system according to claim 13 or 17, wherein said phase characteristic correcting circuit calculates phase characteristics of the reproduced sounds based on detection results of said sound detection circuit by a correlation calculating approach.

21. A sound field correcting method in an audio system including a plurality of signal transmission lines for supplying a plurality of input audio signals separately to a plurality of sound generators, said sound generators comprising at least one first sound generator which generates an all frequency band sound and at least one second sound generator which generates a low frequency band sound exclusively, each of the plurality of signal transmission lines comprising an equalizer which adjusts a frequency characteristic of the audio signal, a channel-to-channel attenuator which adjusts a level of the audio signal, and a delay circuit which adjusts a delay time of the audio signal, wherein the input audio signals are supplied to said sound generators via said equalizer, said channel-to-channel attenuator, and said delay circuit of respective of said signal transmission lines, said method comprising:

a first step of measuring reproduced sounds reproduced by said sound generators by inputting a noise, and then correcting frequency characteristics of said equalizer of each of said signal transmission lines, based on measured results;

a second step of measuring the reproduced sounds reproduced by said sound generators by inputting the noise, and then correcting an adjusted amount of said channel-to-channel attenuator of each of said signal transmission lines having said at least one first sound generator, based on the measured results;

a third step of measuring the reproduced sounds reproduced by said sound generators by inputting the noise, and then correcting delay times of said delay circuit of each of said signal transmission lines, based on the measured results;

a fourth step of measuring independently reproduced sounds reproduced by said at least one first sound generator and reproduced sounds reproduced by said at least one second sound generator; and a fifth step of correcting an adjusted amount of said channel-to-channel attenuator of each of said signal transmission lines, based on measured results measured by the fourth step such that a sum of a spectrum average level of the reproduced sounds in a low frequency band reproduced by said at last one first sound generator, a spectrum average level of the reproduced sound in the low frequency band reproduced by said at least one second sound generator, and a spectrum average level of the reproduced sound in a middle/high frequency band reproduced by said at least one first sound generator are set equal to a ratio of target curve data, wherein the adjusted amount of said channel-to-channel attenuator is corrected based on one data of the sound collecting data, said one data of the sound collecting data having a minimum value with respect to at least one other data of the sound collecting data, wherein a size of said sound generators is determined by comparing gain data with a threshold.

22. The sound field correcting method according to claim 21, wherein measurement of the reproduced sounds in the first step is performed at plural times, and then the frequency characteristics of said equalizer of each of said signal transmission lines are corrected based on plural times measured results.

23. The sound field correcting method according to claim 21, wherein measurement of the reproduced sounds in the second step is performed at plural times, and then the adjusted amount of said channel-to-channel attenuator of each of said signal transmission lines is corrected based on plural times measured results.

24. The sound field correcting method according to claim 21 or claim 22, wherein the frequency characteristics of said equalizer of each of said signal transmission lines are corrected based on multiplied results of the measured result and the target curve data in the first step.

* * * * *